US006237445B1

(12) United States Patent
Wesch, Jr.

(10) Patent No.: US 6,237,445 B1
(45) Date of Patent: May 29, 2001

(54) GRIPPING APPARATUS FOR POWER TONGS AND BACKUP TOOLS

(76) Inventor: William E. Wesch, Jr., 4107 Esmond - No. 1107, Odessa, TX (US) 79762

( * ) Notice: Subject to any disclaimer, the term of this patent is extended or adjusted under 35 U.S.C. 154(b) by 0 days.

(21) Appl. No.: 09/550,959

(22) Filed: Apr. 17, 2000

Related U.S. Application Data

(62) Division of application No. 09/260,302, filed on Mar. 2, 1999, now Pat. No. 6,116,118.

(51) Int. Cl.[7] ..... B25B 17/00
(52) U.S. Cl. ..... 81/57.18; 81/57.33
(58) Field of Search ..... 81/57.15, 57.18, 81/57.33

(56) References Cited

U.S. PATENT DOCUMENTS 4,095,493 * 6/1978 Haynes ..... 81/57.18 X
4,688,453 * 8/1987 Schulze-Beckinghausen ..... 81/57.18
5,161,439 * 11/1992 Wesch ..... 81/57.33
5,172,613 * 12/1992 Wesch ..... 81/57.33

* cited by examiner

*Primary Examiner*—James G. Smith
(74) *Attorney, Agent, or Firm*—Jack A. Kanz

(57) ABSTRACT

Apparatus for gripping tubular members including self aligning gripping jaws with high coefficient of friction for resisting force applied to the elongated member to prevent rotation either clockwise or counterclockwise. Linear cams and cam rollers actuated by a fluid cylinder bring the gripping jaws to an elongated member, applying predetermined gripping force and retract the jaws for removal of the elongated member.

6 Claims, 18 Drawing Sheets

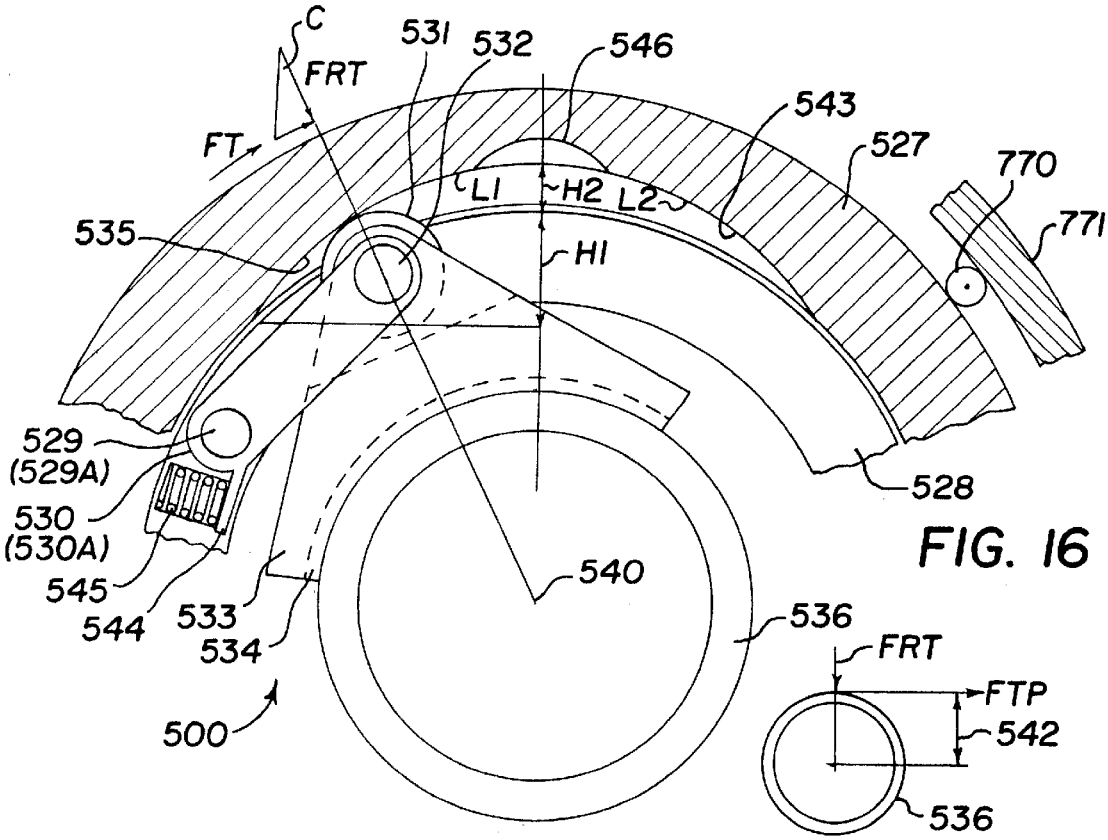
FIG. 16
FIG. 16B
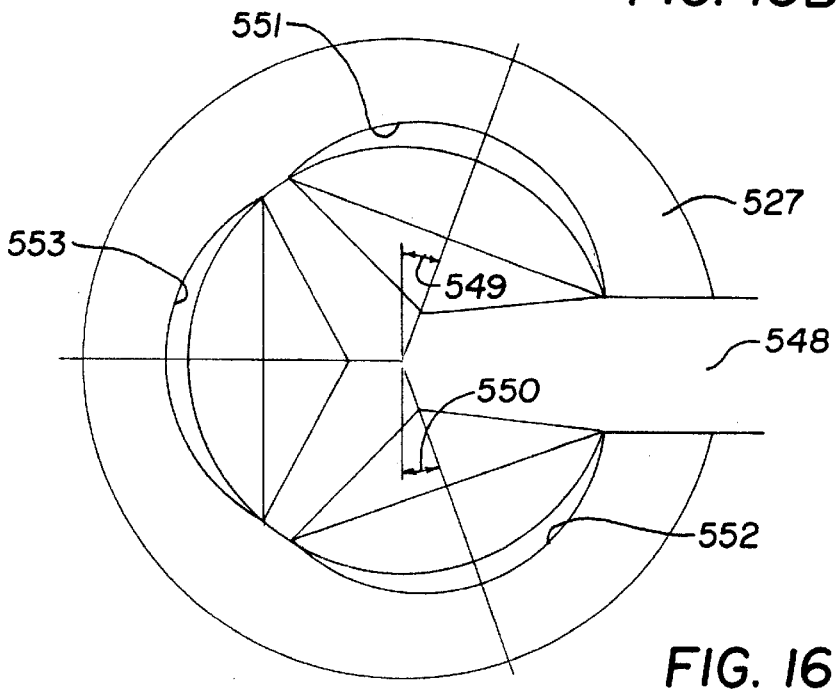
FIG. 16A

GRIPPING APPARATUS FOR POWER TONGS AND BACKUP TOOLS

This application is a division of application Ser. No. 09/260,302 entitled Gripping Apparatus for Power Tongs and Backup Tools filed Mar. 2, 1999 now U.S. Pat. No. 6,116,118.

This invention relates to gripping apparatus for power tongs and backup tools used in the oil and gas industry.

BACKGROUND OF THE INVENTION

Power tongs and backup tools are devices used to secure together (make up) and detach (break out) threaded ends of adjacent sections of tubular products such as production tubing, casing or drill pipe by gripping, applying torque to, and rotating one of the sections. A power tong applies torque to one tubular member section to cause it to rotate. A backup tool holds the adjacent tubular member section much as pipe wrenches are used often in conjunction with a power tong to grip and prevent rotation of the adjacent sections of tubular product. A backup tool is also capable of applying torque to the tubular product section.

Conventional power tongs and backup tools used in the oil industry often damage the tubular sections. In recent years, major oil companies have required that strings of tubular products must be coupled ("made up") and decoupled ("broken out") with a minimum of (i) damage to the tubular products from teeth marks; (ii) deformation of the tubular products; and (iii) cracking of cement or plastic coating on the inside of the tubular products. The goal of these requirements is to minimize concentrations of corrosion and stress on the tubular products resulting from the tears and gouges caused by the gripping teeth of power tongs and backup tools. Also, to maintain integrity of the threaded connection it is desirable to reduce deformation of the pipe by the power tong and backup tool near the location of threads during makeup to assure more compatible meshing of the threads of adjacent products and reduce frictional wear.

U.S. Pat. No. 5,172,613 issued Dec. 22, 1992, entitled "Power Tongs with Improved Gripping Means" ("Wesch I") and U.S. Pat. No. 5,542,318 issued Aug. 6, 1996, entitled "Bidirectional Gripping Apparatus" ("Wesch II") are incorporated herein for all purposes. The Wesch I patent discloses a cam ring turned against a concentric drag ring which moves the gripping assemblies into and out of contact with the tubular surface of the pipe. The Wesch II patent discloses bidirectional gripping assemblies having a double-seated linkage which supports a pivoted jaw within a housing so that the jaw may be used to grip a pipe and exert radial force thereon to hold the pipe against the torque applied in opposite directions. U.S. Pat. No. Re. 31,993 (also incorporated herein by reference for all purposes) issued Oct. 1, 1985, as a reissue of U.S. Pat. No. 4,281,535 and describes apparatus to accomplish the task of making and breaking threaded joints of tubular products using wrap-around pivoted jaw assemblies.

Generally, gouging and tearing of pipe is caused by (i) ineffective gripping assemblies; (ii) gripping jaws having insufficient gripping force; or (iii) the gripping surface of the teeth. These conditions can over-stress the pipe when the radial force is applied in addition to torsion force required to either hold or apply torque to the tubular member. The gripping surface (whether teeth or any other friction surface which increases the coefficient of friction between the gripping assembly and the pipe) must be designed to substantially conform to the outer surface of the pipe even though the pipe may not be round or the tong may not be located transversely to the pipe at the time of gripping. Any improper alignment causes reduced contact areas between the pipe and gripping system. Thus it is important that proper alignment be maintained.

Conventional clamp backup tools apply gripping force to jaws with hydraulic rams or arms actuated directly by hydraulic rams. It has been demonstrated that counterforces on the jaws caused by applied torque may compress oil in the hydraulic rams sufficiently to cause skidding of the pipe on the gripping surfaces. Even at 3,000 P.S.I., oil is soft compared to the mechanically applied gripping force discussed herein.

Normally, conventional tongs and backup tools do not apply the gripping force evenly around the pipe. Instead, it is applied to areas around the pipe which are insufficient to minimize the causes of deformation and teeth marks on the surface of the pipe. The balanced pivoted jaws of U.S. Pat. No. Re. 31,993; U.S. Pat. Nos. 5,172,613 and 5,542,318 solve these problems.

U.S. Pat. No. 5,669,653 discloses a backup tool in which a cam wedge is pushed by a fluid cylinder using pivoted jaws. FIG. 3 of U.S. Pat. No. 4,463,635 also discloses a tool having a wedge block which uses a roller to operate two arms to grip a cylinder. Since the wedge is pushed in the tool disclosed in U.S. Pat. No. 5,669,653 in order to cause gripping of a tubular member, the backup tool is unusually long and cumbersome to mount on the power tong. U.S. Pat. No. 5,669,653 also shows an actuating fluid cylinder with two bolts or pins at its base. Seldom is oil field pipe truly round. Accordingly, if an egg-shaped pipe cross section is gripped, side load is transferred to the wedge and therefore to the fluid cylinder.

SUMMARY OF THE INVENTION

In accordance with the present invention, apparatus is provided for gripping the exterior of a tubular member to resist bidirectional rotation of the member from torque applied about the longitudinal axis of the tubular member. The apparatus comprises a body to receive the tubular member and a reactive gripping jaw attached to the body. A pair of arms having first and second ends is provided. Each of the arms is pivotally mounted on the body about an axis parallel with the longitudinal axis of the tubular member. The first end of each arm supports an active gripping jaw and the active gripping jaws, in conjunction with the reactive gripping jaw, receive and secure the tubular member.

A force multiplying device is interposed between the second ends of the arms for engagement with the second ends of the arms. An actuator is coupled to the force multiplying device for moving it in a first direction to engage the second ends of the arms and pivot the arms and move the active gripping jaws so that the tubular member is secured between the reactive gripping jaw and the active gripping jaws with force sufficient to prevent rotation of the tubular member at a predetermined applied torque. The active gripping jaws are disengaged from the tubular member by returning the force multiplying device to its initial position.

In one embodiment the force multiplying device comprises a roller attached to the second end of each arm and a wedge member with two inclined surfaces intermediate the pair of arms for engaging the roller of each arm. Biasing apparatus is provided for maintaining engagement of the rollers against the inclined surfaces in another embodiment the force multiplying device comprises an arcuate cam surface on the second end of each arm and rollers operatively coupled to the actuator for engagement with the arcuate cam surfaces of the arms. Biasing apparatus is also provided for mounting engagement of the rollers with the arcuate cam surfaces. In yet a third embodiment the force multiplying device comprises a toggle block pivotally coupled to the arms with toggles.

In accordance with the present invention the force applied to the pipe outer surface is predetermined and mechanical instead of applied by a hydraulic ram directly to the jaw. The consequential radial loading to the three jaws on the pipe outer surface is sufficient to keep the pipe from rotary skidding at the gripping surfaces when a predetermined torque is applied to the pipe.

In the present invention surfaces on jaws having a high coefficient of friction are urged into frictional engagement with the surface of an elongated member having an outer surface and a longitudinal axis. When force is applied to the elongated member to rotate the elongated member either clockwise or counterclockwise, the surfaces of the jaws are clamped to the elongated member.

For any given torque the radial force is predetermined and uniformly applied on the pipe. The gripping jaw area, as well as number and size of hardened teeth, are predetermined to reduce the forces which tend to cause teeth marks or crush the tubular body to a magnitude less than the yield strength of the tubular body. In other words, the number and shape of the hardened teeth in the gripping surface are predetermined so that the force of the teeth on the pipe does not exceed the elastic limit or the ultimate strength of the pipe material at maximum torque. Apparatus employing the invention will hold pipe against either clockwise or counterclockwise rotation, thus obviating the need for changing the structure or the magnitude of force required to hold the pipe against torque applied in either direction.

Where marks are absolutely forbidden, the gripping jaw surfaces may be smooth or sandpaper-like and the gripping force increased sufficiently over standard gripping jaw surfaces to keep the gripping jaw surfaces from skidding on the elongated member.

In another embodiment a backup tool is provided with a jaw assembly including replaceable gripping inserts with hardened teeth. This embodiment is designed to engage varying diameter tubular members with a gripping force proportional to the applied torque and acts as a unidirectional backup tool with a support system to accommodate reversal of the backup tool for applying gripping force to make or break threads in either direction of the power tongs. Other features and advantages of the invention will become apparent to those skilled in the art in view of the following description taken in connection with the appended claims and attached drawing in which:

BRIEF DESCRIPTION OF THE DRAWING

FIG. 16 is a plan view of a power tong gripping jaw.

FIG. 16A is a plan view of a cam ring in a power tong.

FIG. 16B shows power tong force vectors.

DESCRIPTION OF PREFERRED EMBODIMENTS

Figure 1:
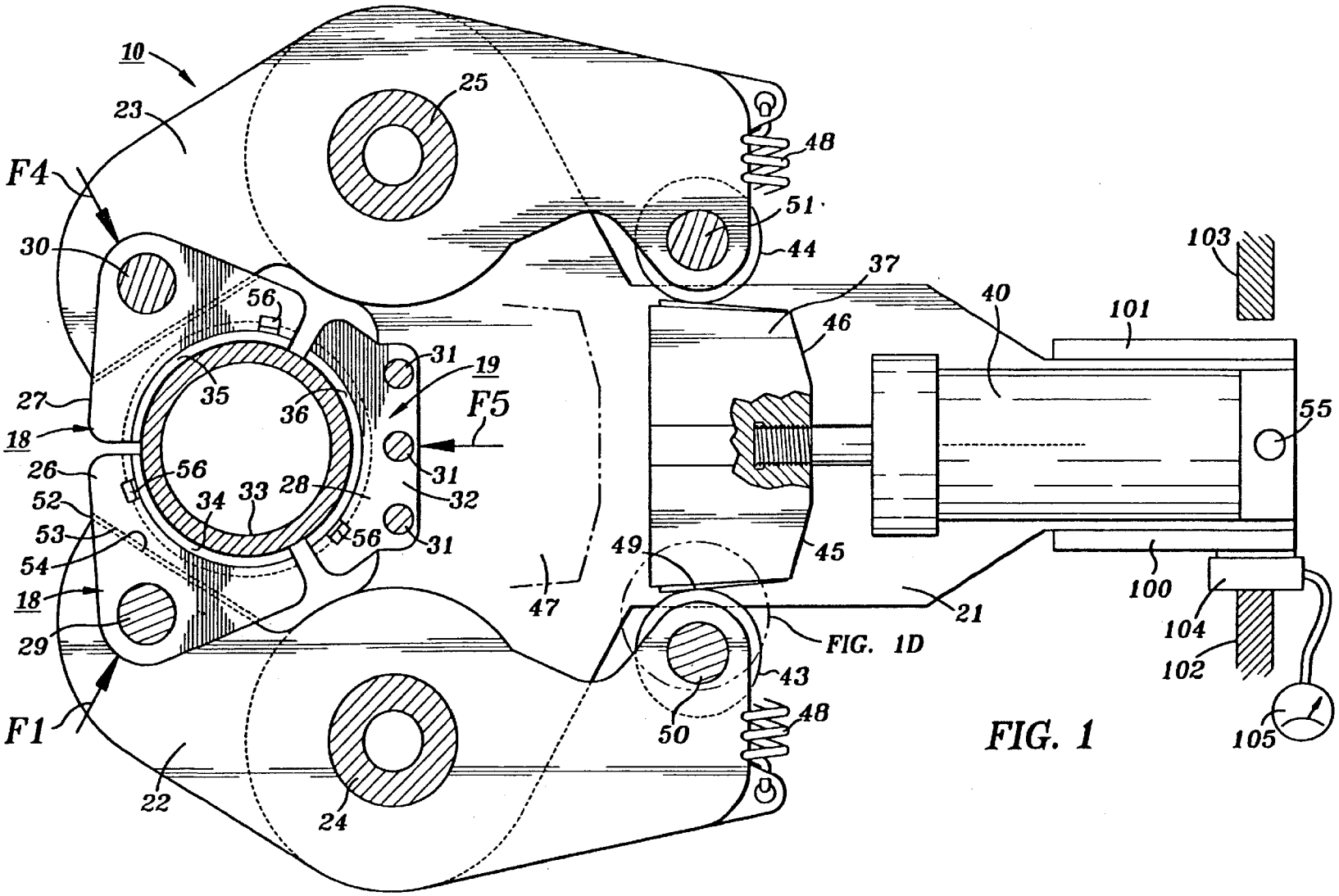
FIG. 1 is a plan view of a bidirectional backup tool in accordance with the present invention which has a pipe clamped in the jaws of the tool.
Figure 1B:
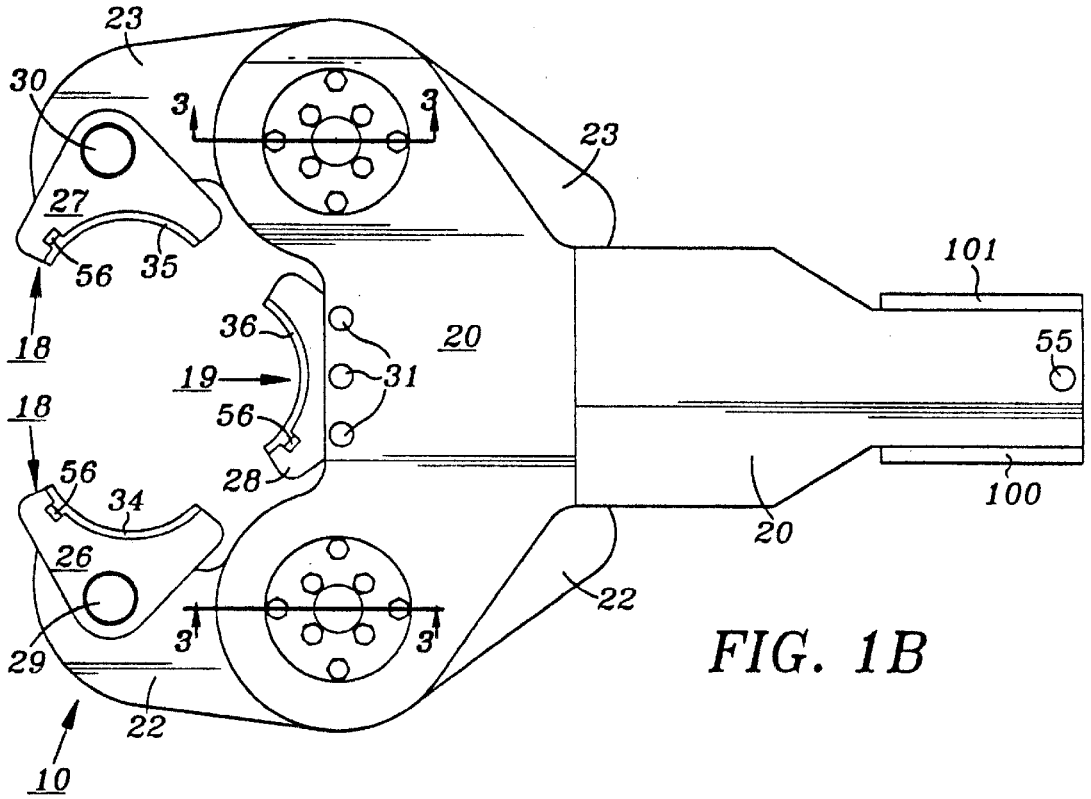
FIG. 1B is a plan view of the bidirectional backup tool with jaws open.
Figure 1A:
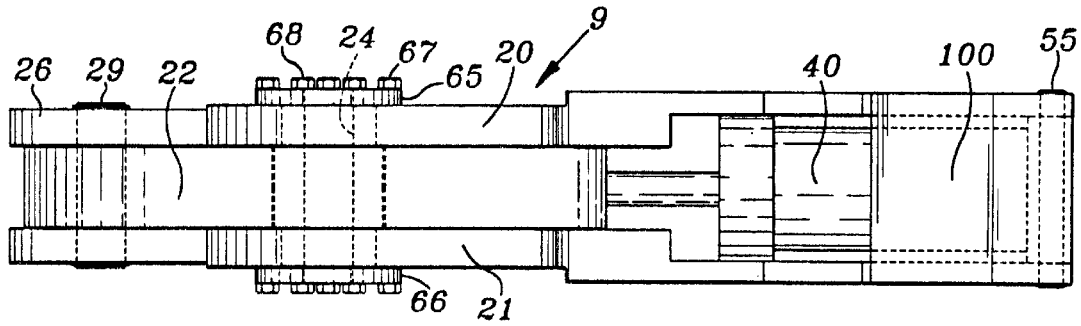
FIG. 1A is a side elevation view of the bidirectional backup tool of FIG. 1.

FIGS. 1, 1A, 1B, 1C, 1D and 2 illustrate a bidirectional backup tool 10 which has a frame or body 9 formed by spaced top and bottom plates 20 and 21, respectively, with a pair of pivot arms 22 and 23 pivotally secured to the body 9 by pivot pins 24 and 25, respectively. Active jaws 26 and 27 and reactive jaw 28 are positioned within the bidirectional backup tool 10. Active jaw 26 is attached to pivot arm 22 by jaw pin 29 and active jaw 27 is attached to pivot arm 23 by jaw pin 30. Reactive jaw 28 is attached between top and bottom plates 20 and 21, respectively, by bolts 31 which also space top and bottom plates 20 and 21 apart by the width of flange 32 on reactive jaw 28. While FIG. 1 depicts the components of backup tool 10 as symmetrical about a center line from left to right, those skilled in the art will appreciate that the components of such a tool may not always be absolutely symmetrical.

Pipe 33 is held within active jaws 26 and 27 and reactive jaw 28 by hardened replaceable inserts 34, 35 and 36, respectively, which substantially conform to the outside diameter of the pipe. Inserts 34, 35 and 36 have friction surfaces adjacent the pipe to increase the coefficient of friction. These may be teeth, a sandpaper-like finish or other finish for the inserts 34, 35 and 36 or a brake-band type material or non-ferrous alloy design to minimize damage to the pipe under full compressive load. Replaceable inserts 34, 35 and 36 may, for example, be secured to backup tool 10 in dovetail grooves 26*a* (FIG. 4) or by screws.

Conventional backup tools apply gripping force to the pipe through hydraulic rams. However, the counterforce (which is generated by the pipe as torque) tends to open the jaws by compressing the oil in the hydraulic cylinders. The embodiment shown as backup tool 10 eliminates that problem by using a force loading block or wedge block 37 (FIG. 2) with inclined surfaces providing cam-like or ramp faces. The inclined surfaces preferably have inserts 38 and 39. Inserts 38 and 39 are preferably replaceable and are secured to force loading block 37 by 72 and 73 and 72*a* and 73*a*, respectively. The piston of fluid cylinder 40 is in threaded engagement with force loading block 37.

By actuating fluid cylinder 40 (which may be a hydraulic or air cylinder), force loading block 37 is pulled to the right (in FIG. 2) causing the pivot arms 22 and 23 to pivot around the pivot pins 24 and 25. Active jaws 26 and 27 of pivot arms 22 and 23 are thus moved into engagement with the pipe 33. Initially, edges 45 and 46 of force block 37 engage rollers 43 and 44 of pivot arms 22 and 23 which moves active jaws 26 and 27, respectively, snugly against pipe 33. Thereafter, cam surfaces on inserts 38 and 39 engage rollers 43 and 44 and pivot arms 22 and 23 rotate about pivot pins 24 and 25, respectively, applying force through active jaws 26 and 27 against the pipe 33. The pipe 33 thus abuts reactive jaw 28 in proportion to the pulling force of fluid cylinder 40. To release the pipe 33, force block 37 is pushed by fluid cylinder 40 to the left in FIGS. 1 and 2 into the retracted position shown in FIG. 2.

The combination of force loading block 37 and the rollers on pivot arms 22 and 23 comprise a force multiplying device because the force exerted on rollers 43 and 44 by the actuator 40 to move the arms so that the active jaws are brought into gripping engagement with the pipe is substantially less than the force applied to the surface of the pipe.

An extension spring 48 is attached to each pivot arm 22 and 23. Extension spring 48 functions to bias rollers 43 and 44 toward surfaces 45 and so that the pivot arms 22 and 23 to move active jaws 26 and 27 in and out of engagement with pipe 33.

Since the radial force FRT on pipe 33 is very large, all rollers and cam surfaces must withstand the large compressive stresses generated during operation. Hardness of Rockwell C-29 to C70 is required. Rockwell C-37 to C62 is preferred.

As shown in FIG. 1 the top and bottom plates 20 and 21 are tied together by plates 100 and 101 which may be welded to both. These bear against legs 102 and 103 rigidly attached to a power tong. Torque may be measured with a pancake fluid cylinder 104 between plate 100 and leg 102 and connected to pressure gauge 105.

In operation, load block 37 is pulled by fluid cylinder 40 from position 47 to the position shown in FIG. 1. This brings the insert 34 and insert 35 of active jaws 26 and 27, respectively, snug against the outer surface of pipe 33 abutting reactive jaw 28. Further pull by fluid cylinder 40 increases the forces applied (denoted as force F1 on insert 34, force F4 on insert 35 and F5 on insert 36) to the surface of pipe 33 to a force predetermined to be sufficient to hold the pipe from rotating.

If force F1 (FIG. 1C) is known, then the force F3 (FIG. 1D) on roller 43 where it contacts the angular cam section at point 49 can be determined. Force F2 is determined by multiplying the tangent of the cam angle A times the force F3. Two times the force F2 is used to determine the sizing of fluid cylinder 40.

When resisting rotation of pipe 33, any counterforce generated by the gripping force FT of inserts 34, 35 and 36 (FIG. 1C) against the pipe 33 is applied directly to rollers 43 and 44 and thus against the hard surfaces of force block 37 or inserts 38 and 39. Compression of the fluid in cylinder 40 is thus minimized and a very rigid clamping arrangement is obtained. The length of insert 38 is sufficient to allow fluid cylinder 40 to force roller 43 in a clockwise direction around pivot pin 24 and roller 44 in a counterclockwise direction around pivot pin 25 with sufficient movement to allow for tolerances in pivot pins 24 and 25, jaw pins 29 and 30, and roller pins 50 and 51 and variations in the pipe 33 outside diameter and still maintain in constant force on roller 43 and 44. The total gripping force applied when rollers 43, 44 are in contact with inserts 38, 39 is the sum of force F1, F4 and F5 (designated as force FRT in FIG. 1C), Force FRT is the force required to overcome the tangential force (FT in FIG. 1C) by a grip factor (FRT÷FT) of about 1.2 to as much as 15 or more. The grip factor varies, of course, depending on insert gripping surface configuration and contact area of the active jaws 26, 27 and reactive jaw 28. This configuration is predetermined to minimize damage to the pipe 33. The tangential force FT in inch-pounds is determined by multiplying the applied torque from the power tong by twelve (12) and dividing that value by the outside radius of pipe 33. This value is the force which must be overcome by the grip factor applied to radial force FRT. It will be appreciated that inserts 34, 35 and 36 may be different thickness to accommodate the outside diameter of various pipe sizes. Thus several pipe sizes may be handled by the backup tool by changing only the inserts without changing the jaws. The total radial force (FRT) is determined by calculation and is normally three to four times the tangential force (FT) but may be adjusted by trial and error. Rollers 43 and 44 are centered in pivot arms 22 and 23 by roller pins 50 and 51.

Pipe 33 is an elongated cylindrical product such as a hollow joint, tubing, casing, solid bar, drill pipe or other tool used in well drilling, completion and servicing operations. While the tubular product illustrated in FIG. 1 is circular, it should be appreciated that the cross-section of the tubular product may be other than circular. If desired, a mechanical advantage can be realized to reduce the forces of the rollers 43 and 44 on the inserts 38 and 39, respectively, by reducing the distance between jaw pins 29 and 30 and pivot pins 24 and 25, respectively, or by increasing the distance between pivot pins 24 and 25 and roller pins 50 and 51, respectively.

The space 52 (FIG. 1) between pivot arm 22 and active jaw 26 may be confined by surfaces 53 and 54. This space is predetermined to limit the rotation of active jaw 26 with respect to pivot arm 22. This applies as well to active jaw 27 and any other pivoted jaw arrangements, e.g., the embodiment of FIG. 7.

The entire gripping system indexes on the outer surface of pipe 33. The active jaws 26 and 27 are pushed against the pipe 33 by pivot arms 22 and 23 when actuated by rollers 43 and 44 moving on surfaces 45 and 46 and inserts 38 and 39 on force loading block 37. In turn pipe 33 is forced into reactive jaw 28. Should the pipe 33 be out of round or otherwise not aligned with the inserts 34, 35 and 36, the force loading block 37 can move angularly compensate and assure an even gripping. Angular compensation is possible because the fluid cylinder 40 may pivot on pin 55 so that the force loading block 37 may move as required to assure alignment with pipe 33. Active jaw 27, reactive jaw 28 and inserts 35, 36 have keyways 56*a* and keys 56 similar to those in active jaw 26 and insert 34.

Figure 1C:
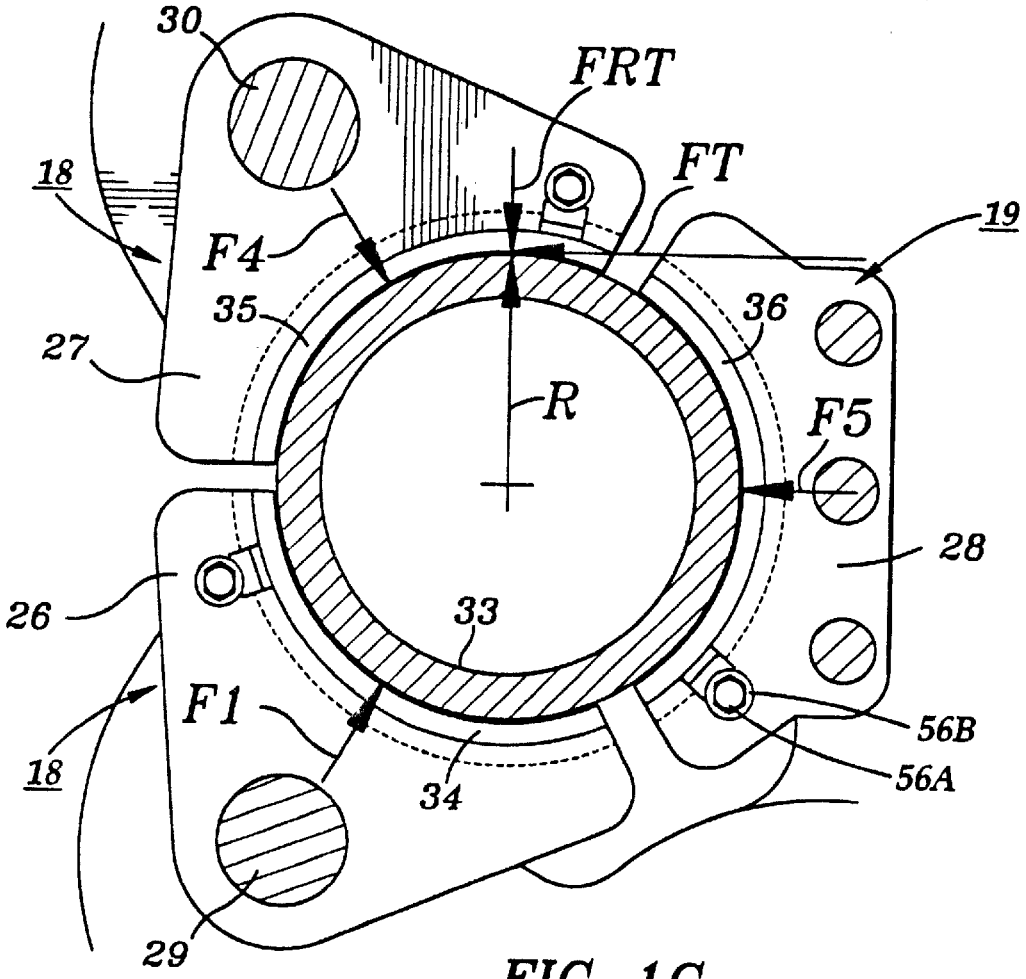
FIG. 1C is a partial break-out of the jaw in FIG. 1 to illustrate various force vectors.
Figure 1D:
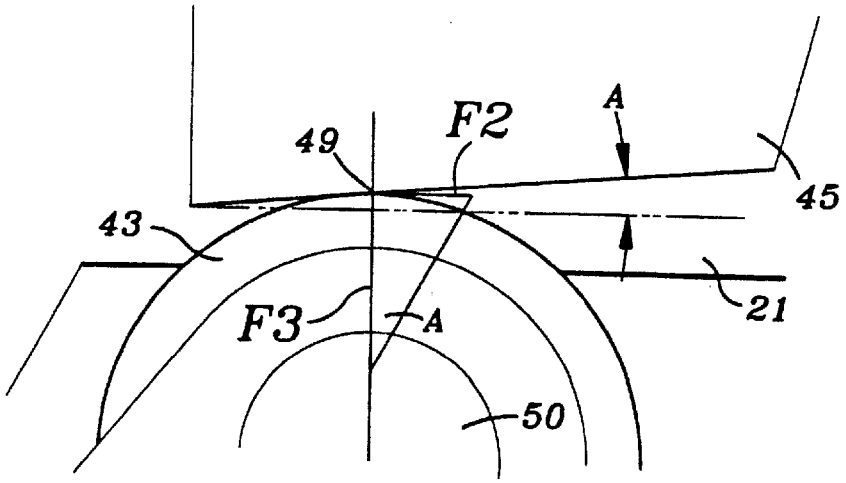
FIG. 1D is an enlarged break-out of the circled area in FIG. 1.
Figure 2:
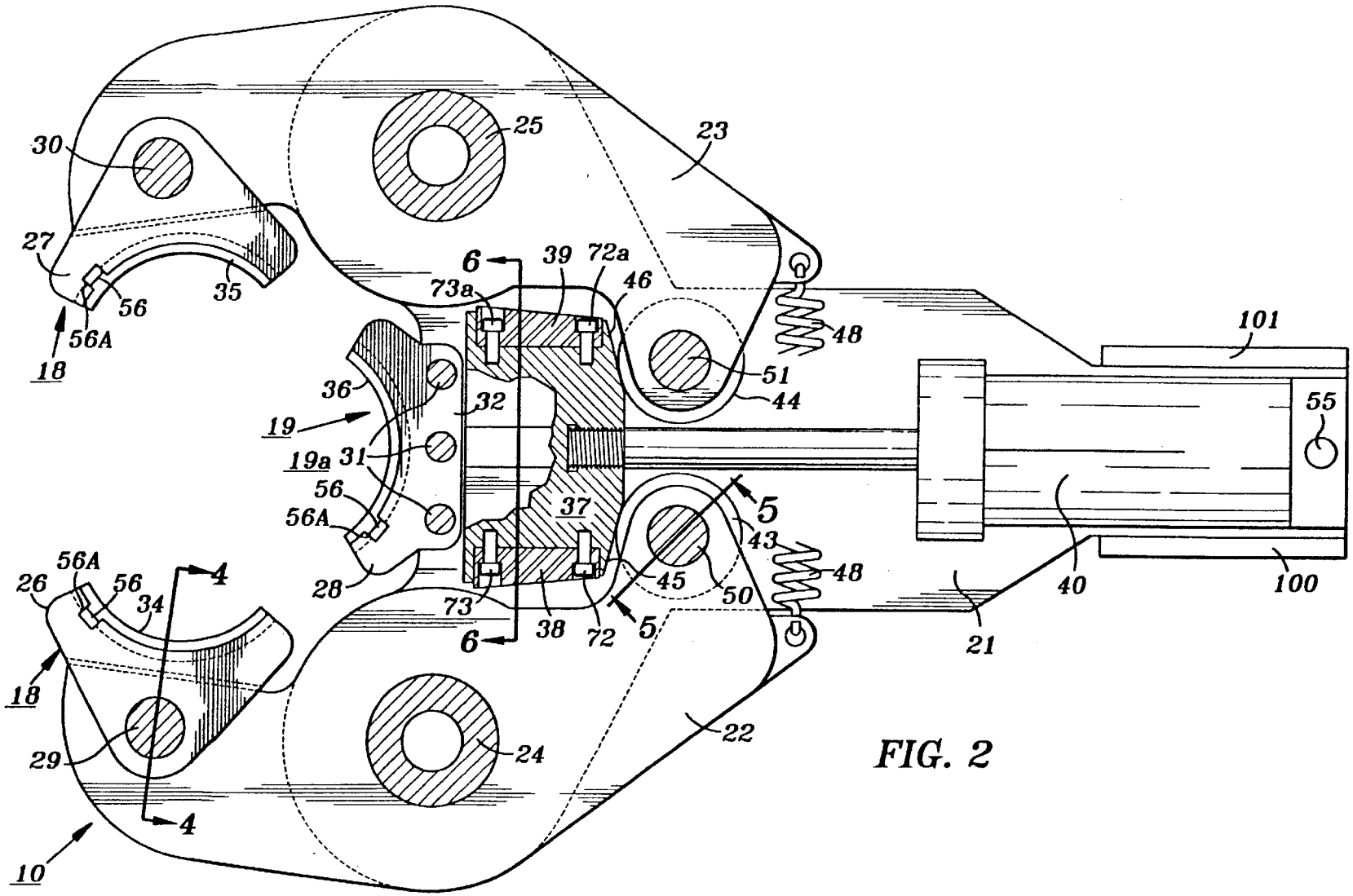
FIG. 2 is a plan view of bidirectional backup tool with jaws open.

In FIG. 2 the backup tool 10 is illustrated with the jaws open. Insert 34 is secured to active jaw 26 by a key 56 in a keyway 56*a*. With insert 34 installed, the torque forces are absorbed by the key 56. Key 56 extends substantially through the length of insert 34 and is retained by bolt 56A and washer 56B as shown in FIG. 1C.

Figure 3:
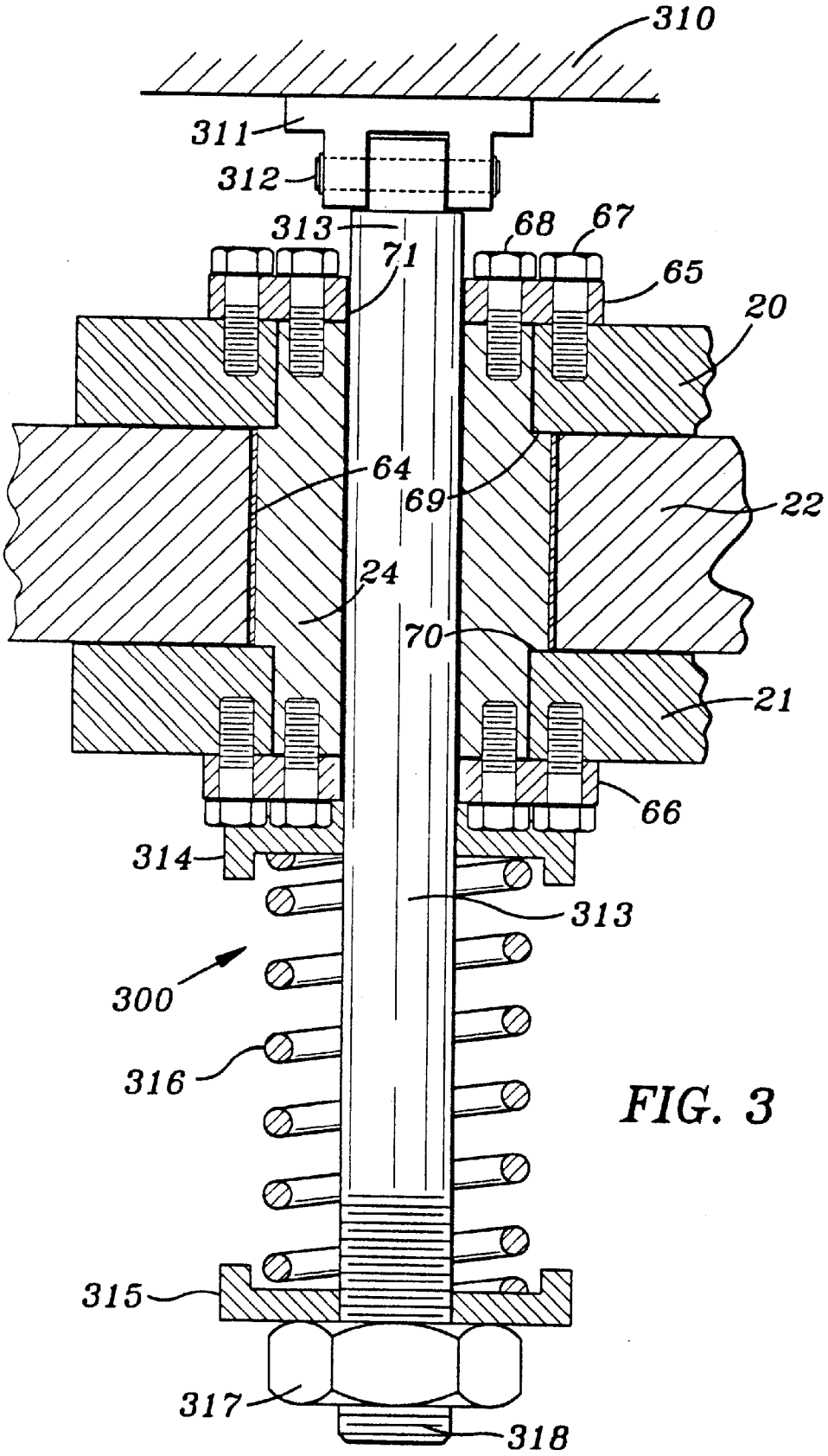
FIG. 3 is a partial sectional view taken along section 3—3 of FIG. 1B with a spring supporting mechanism.

FIG. 3 is a sectional view taken through pivot arm 22 and pivot pin 24. The pivot pin 24 is seated in bushing 64 of pivot arm 22 and secured between upper plate 20 and lower plate 21 bearing on shoulder surfaces 69 and 70 which allows a clearance fit to pivot arm 22. The pivot pin 24 is secured to the top plate 20 and the bottom plate 21 by retaining plates 65 and 66. A plurality of bolts 67 secure plate 65 to top plate 20 and plate 66 to lower plate 21 and a plurality of bolts 68 securing upper plate 65 and lower plate 66 to pin 24. The bore 71 through pin 24 is provided so that the spring supporting mechanism 300 for the bidirectional backup tool 10 (FIG. 1) to be attached to a power tong 310. A bar 313 through bore 71 with a clearance fit extends through bidirectional backup tool 10, and a compression spring 316 is secured to that bar by plates 314 and 315 adjusted and retained by nut 317 on threads 318, so that the backup tool may deflect axially on the pipe as the threaded joints are coupled or decoupled. The top end of bar 313 is pivotally attached by pin 312 to adapter plate 311 welded to or made a part of power tong 310. Two bars 313 and spring assemblies are used, one on each side of pipe 33. The suspension system may be any conventional system.

Figure 4:
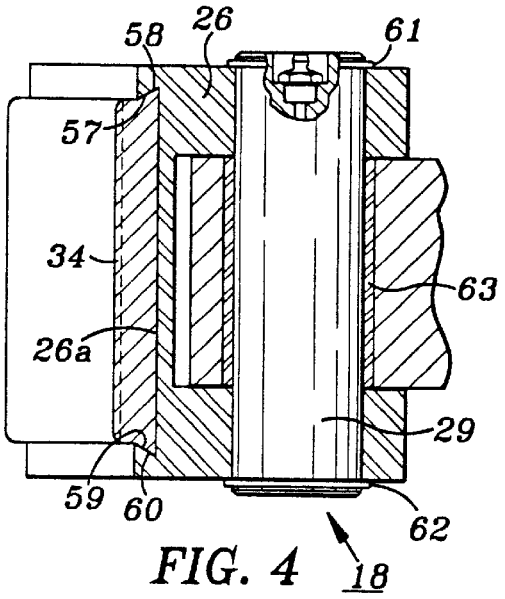
FIG. 4 is a partial sectional view taken along lines 4—4 in FIG. 2.

FIG. 4 shows the insert 34 retained in the active jaw 26 by dove tail groove 26*a*. Surfaces 58 and 60 are designed to allow insert 34 to slide radially into the active jaw 26. The surfaces 57 and 59 of insert 34 engage the surfaces 58 and 60, respectively, to retain the insert 34 within active jaw 26. Inserts similar to insert 34 are retained in active jaw 27 and reactive jaw 28. All the inserts may be changed without removing the jaws. Active jaw 26 secured around jaw pin 29 and is retained by retainer rings 61 and 62. Jaw pin 29 preferably has bushing 63. Other mechanical means may be used to retain the inserts within jaws.

Figure 5:
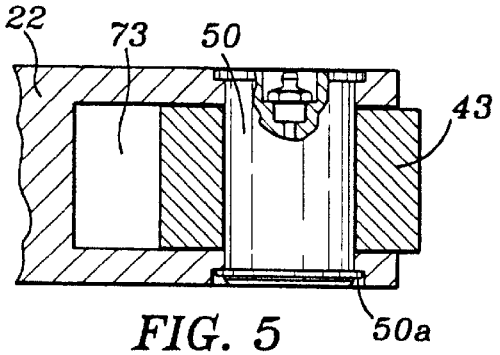
FIG. 5 is a partial sectional view taken along lines 5—5 in FIG. 2.

As shown in FIG. 5 roller 43 is secured by roller pin 50 and retained by retainer ring 50*a*. Roller 43 is mounted in a slot 73 in pivot arm 22, and roller 43 has a clearance fit within the slot 73. Roller 44 uses the same arrangement as shown in FIG. 5.

Inserts 38, 39 may be changed so that different force angles A (FIG. 1D) may be utilized to either increase or decrease force on the pipe 33. Optionally, load block 37 may have a projections 75 which slide in grooves 74 along the centerline of pipe 33 to provide additional control of load block 37 during the stroke of fluid cylinder 40. Although not necessary, load block 37 may have projection 75 on the top or bottom, or both top and bottom. Projection 75 would then have corresponding grooves 74. Inserts 38 and 39 of load block 37 have a clearance sliding fit between top plate 20 and lower plate 21.

Referring back to FIG. 2, it will be noted that jaw assembly 19 (which is a reactive jaw) may be used in all three gripping jaws; one to pivot arm 22, one to pivot arm 23, and one in the throat 19*a* attached to top and bottom plates 20 and 21 as shown in FIG. 2. This arrangement would be used where equal gripping on the pipe 33 is not an absolute requirement. Any combination of jaw assemblies 14, 15, 16, 17, 18, 19 or 20A may be used on any backup tool or power tong.

Figure 7:
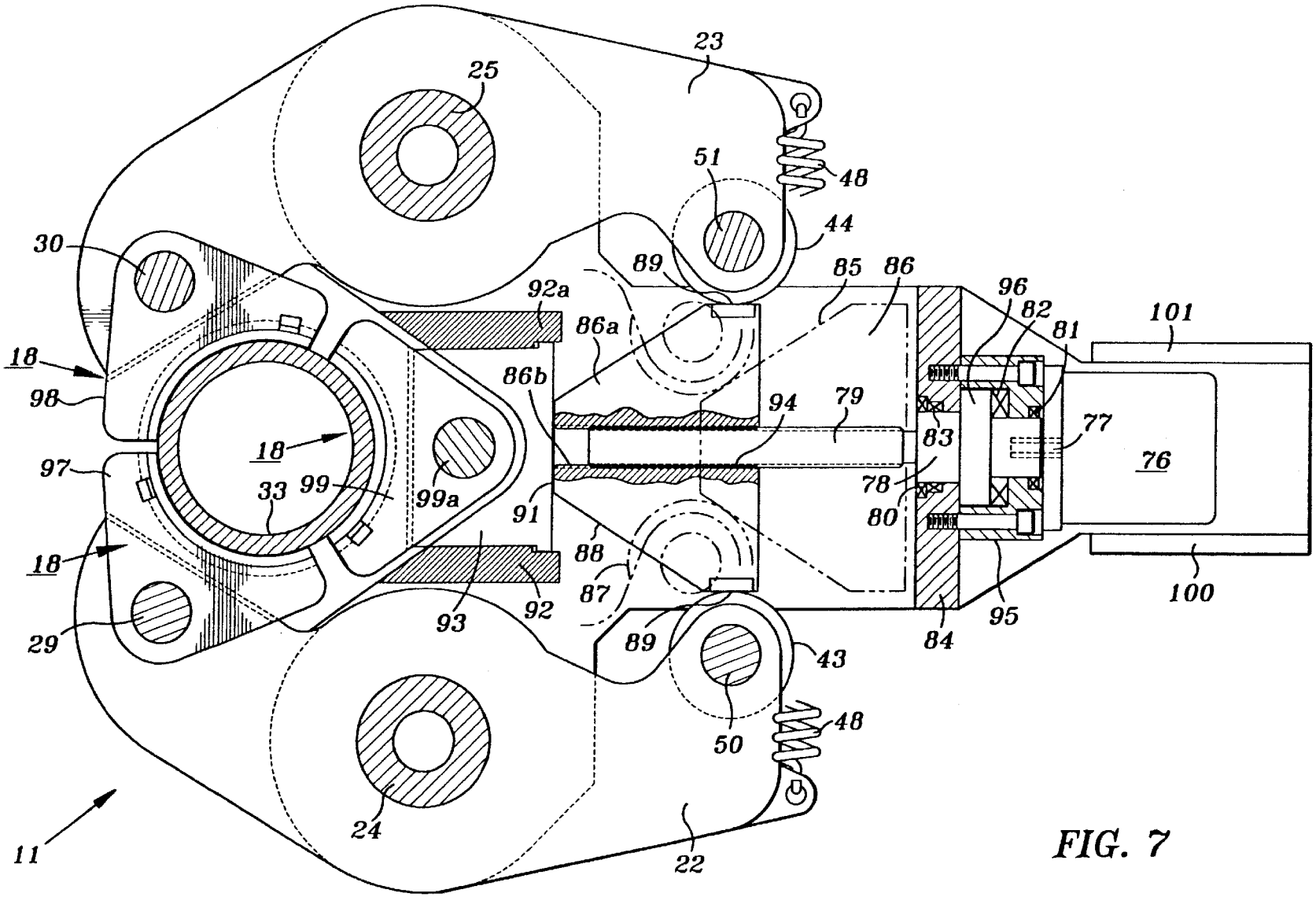
FIG. 7 is a plan view of an alternate embodiment of the bidirectional backup tool with jaws closed.

Backup tool 11 shown in FIG. 7 is a modification of backup tool 10. In backup tool 11 pivot arm 22 and pivot arm 23 are actuated by movement of rollers 43 and 44 in a different manner than backup tool 10. For example, backup tool 11 has a fluid motor 76 which is used to push force loading block 86 from position 85 toward the pipe and to pull force loading block 37 from position 86*a* away from the pipe 33. Fluid motor 76 is attached to force loading block 37 using an adapter 95. The spline 77 of fluid motor 76 engages drive shaft 78 which contains a buttress or acme-type thread 79 engaging threads 94 within the threaded bore 86 toward the pipe 33 so that roller 43 is pushed into engagement position along ramp 88 until roller 43 contacts force block 86 at position 89. When roller 43 touches force block 86 at position 89, force block 86 engages and pushes crosshead 93 along surface 91. Crosshead 93 supports active jaw 99 or other jaw assemblies described herein which is pushed by force block 86 into pipe 33, forcing pipe 33 into reactive jaws 97 and jaw 98. The force exerted by threads 79 and the force block 86 against crosshead 93 is predetermined and sufficient to hold the pipe 33 from rotation. When force block 86 is pushed against crosshead 93, the reactive force through thread 79 is taken by thrust roller bearing 82 which is force against boss 96 on shaft 79.

Top plate 20 is not shown in FIG. 7 for ease of illustration. Body members 92 and 92A are positioned between top plate 20 and lower plate 21 as an integral part thereof. Crosshead 93 slidingly fits between body or frame members 92 and 92A.

Drive shaft 78 is contained in body or frame member 84. The fluid motor adapter 95 contains grease seal 81 and a zerk fitting (not shown) is used to inject grease into bearings 82 and 83.

In FIG. 7 the force block 86 is shown in the gripping position 86 and has moved up from position 85 into the actuated gripping position 86*a*. Force block 86 could be actuated by a fluid cylinder pushing force block 86 back and forth rather than the fluid motor 76.

Figure 8:
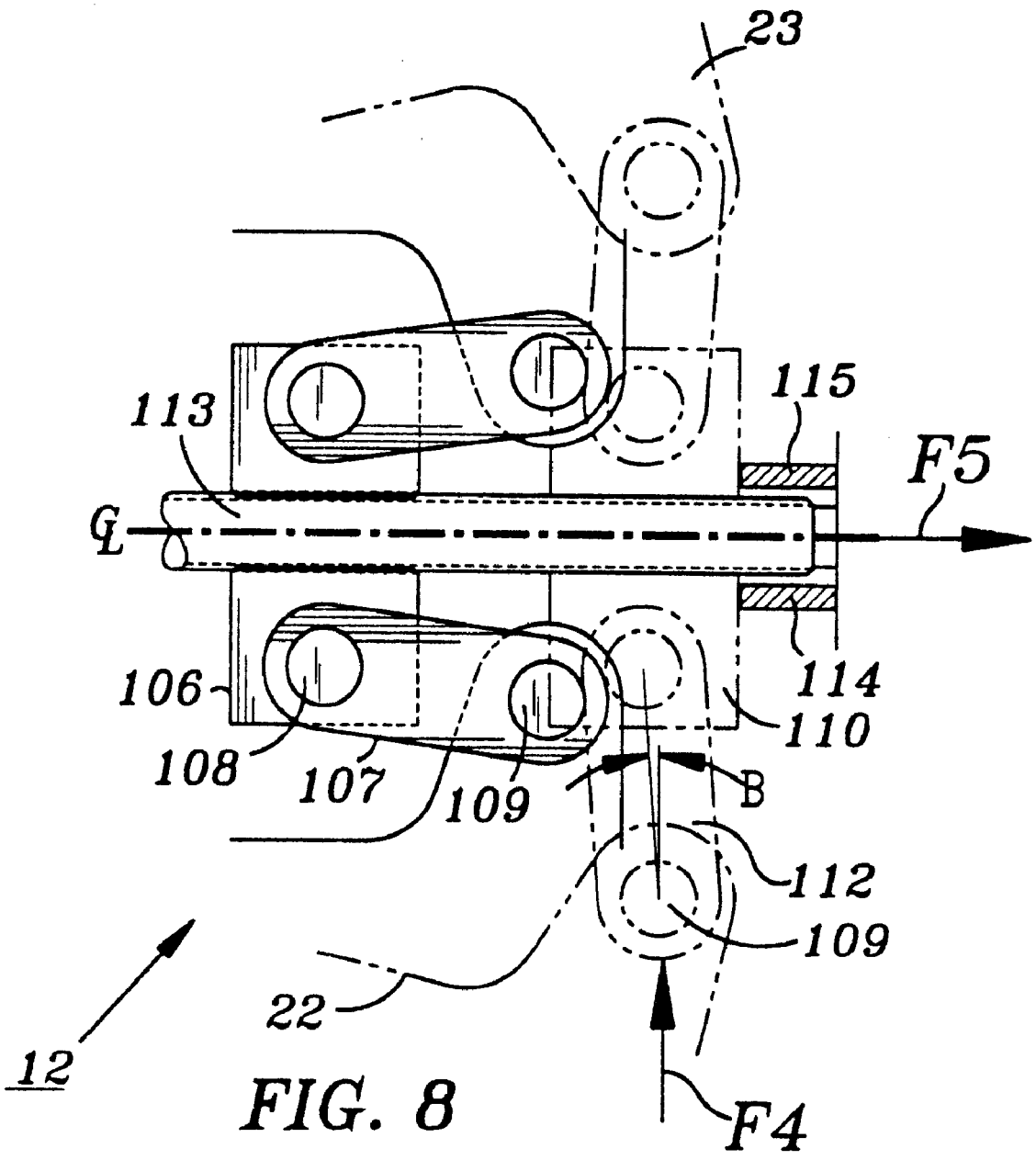
FIG. 8 is a plan view of a toggle arrangement for moving the jaws into engagement with the pipe.

FIG. 8 shows an alternate structure for causing arms 22 and 23 to pivot outward and force engagement of the active jaws 26 and 27 on the pipe 33. The tool illustrated in FIG. 8 uses a toggle arrangement 12 wherein a traveler toggle block 106 is shown in the retracted position and in the load position 110 (dotted lines). Toggle link 107 is connected at one end to toggle block 106 by pin 108 and connected to pivot arm 22 by pin 109. Toggle link 107 is shown in the retracted position and as in the actuated gripping position 112 (dotted lines). Toggle block 106 in conjunction with toggle link 107 comprise a toggle joint.

Full gripping force is applied by virtue of force F5 which may be applied by a screw thread as in FIG. 7 or by a fluid cylinder which pushes or pulls it from left to right as in FIG. 1. When toggle block is pulled to the right it is stopped by frame members 114 and 115. Frame members 114, 115 are permanently attached to the top and bottom plates 20 and 21 with toggle 107*a* forming angle B which is anywhere from one (1) to perhaps fifteen (15) degrees. After force F4 is determined in the same manner as force F3 in FIG. 1D, then force F5 (which is the force required to be applied to shaft 113 by the fluid motor or fluid cylinder 76) is determined by multiplying the tangent of angle B times the force F4 times two. The fluid cylinder size of fluid motor screw arrangement, if used, can then be determined.

The combination of the toggle block 106 and toggle links 107 also constitutes a force multiplying device. The force applied by the jaws to pipe 33 is substantially greater than the force to pull toggle block to gripping position.

Figure 9:
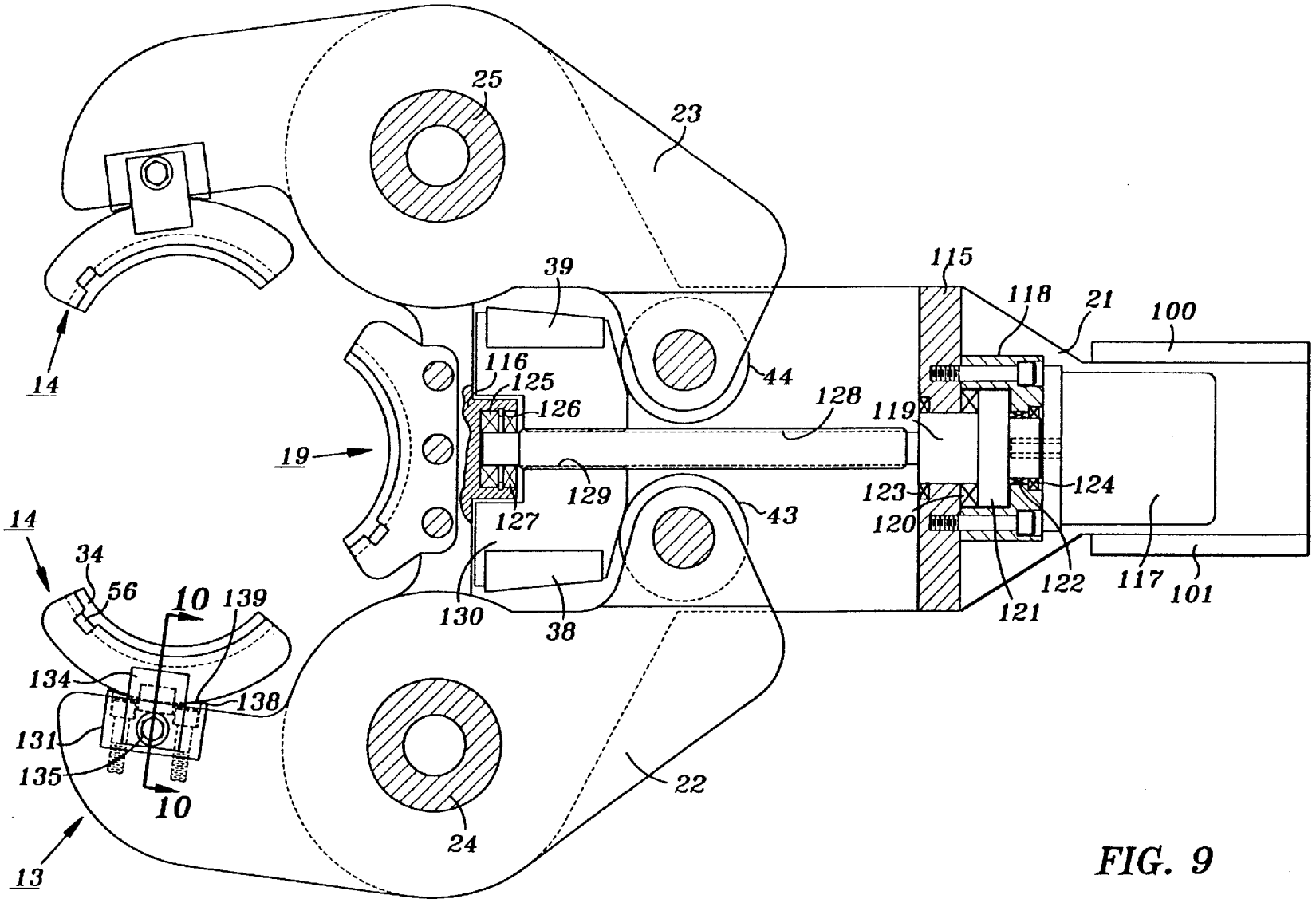
FIG. 9 is a plan view of an alternate embodiment of the bidirectional backup tool with jaws open.

FIG. 9 illustrates a modification of backup tool 10 wherein load block 130, which is similar to load block 37, is actuated by fluid motor 117 which pulls load block 130 to actuate pivot arms 22 and 23. The forces involved in pulling the load block 130 to put the desired force against rollers 43 and 44 is calculated the same as disclosed in connection with backup tool 10 (FIG. 1). Fluid motor 117 is attached to adapter 118 which contains roller bearing 122 and grease seal 124. The flange 121 on shaft 119 bears against thrust bearing 120. Grease is retained by grease seal 123 and zerk fittings (not shown) are provided to grease bearing 120. The threaded portion 128 of shaft 119 is buttress-type or acme-type thread.

Fluid motor 117 turns threaded portion 128 of shaft 119 in mating thread 129 inside load block 130 to pull load 130 into the actuated position. The other end of shaft 119 contains a bearing 125, a retainer ring 126 and a grease seal 127 with means (not shown) to grease the bearing. This is housed within a portion of the body 9 of the backup tool 10 which connects top plate 20 and bottom plate 21 as described in connection with FIG. 1. Backup tool 13 may use any of the jaw configurations backup tool 10 would use.

Figure 10:
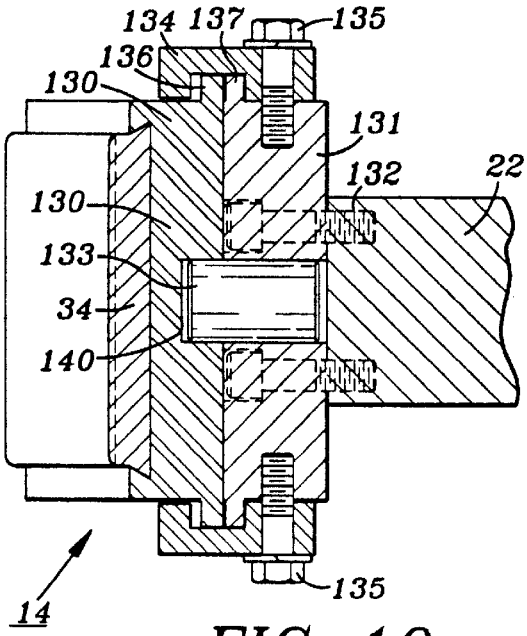
FIG. 10 is a partial sectional view taken along the lines 10—10 of FIG. 9.

FIG. 10 shows a jaw assembly 14 which contains a jaw base 131 bolted to pivot arm 22 by bolt 132. Dowel 133 is pressed into jaw base 131 and loosely fits into hole 140 in jaw segments 130. The loose fit of dowel 133 in hole 140 allows jaw segment 130 to roll slightly either on a flat face of jaw base 131 or on a curvature slightly larger than the outside radius of jaw segment 130. This allows some small alignment with pipe 33 outside diameter to make up for irregularly shaped cross section on pipe 33. Insert 34 is retained within jaw segment 130 by mechanical means. One arrangement of jaw assembly 14 which may be used is shown in FIG. 10. Jaw segment 130 is loosely retained by clip 134 which fits over the projection 136 from jaw segment 130 and projection 137 from jaw base 131 and is secured by bolts 135. Being loosely retained, jaw segment 130 may rotate slightly on surfaces 139 or 138 (FIG. 9). This arrangement secures jaw segment 130 top and bottom.

Figure 11:
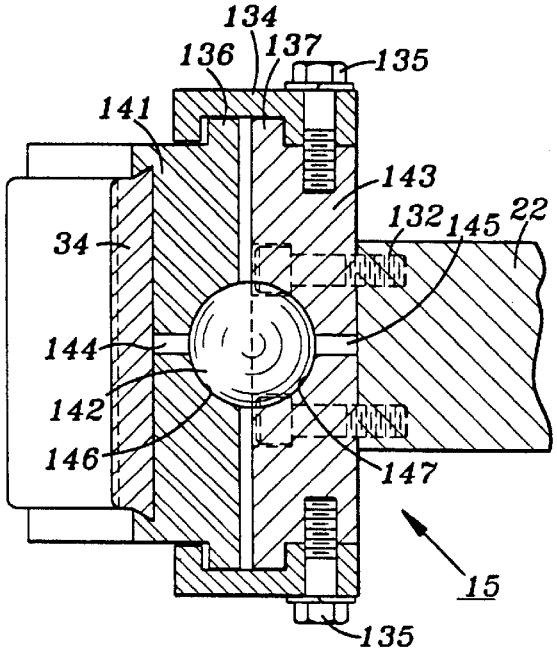
FIG. 11 is an alternate embodiment of the jaw assembly of FIG. 10.

FIG. 11 shows a jaw assembly 15 which is designed not only to adjust to the pipe outer surface, but also to align itself axially with the pipe 33. In jaw assembly 15 the jaw base 143*a* is rotatably associated with jaw segment 141 by steel ball 142 which is contained within hemispherical recess 146 in jaw segment 141 and hemispherical recess 147 within jaw base 143. It is necessary in machining hemispherical recesses to have relief hole 144 and relief hole 145. Here again, jaw segment 141 is retained in the same manner as jaw assembly 14 in FIG. 10. Ball 142 bears both radial and torque loads. Means for applying lubricant to ball 142 are provided (not shown). In some cases, it may be desired that ball 142 be permanently secured to either jaw segment 141 or jaw base 143 so that the wear is only on one part.

Figure 12:
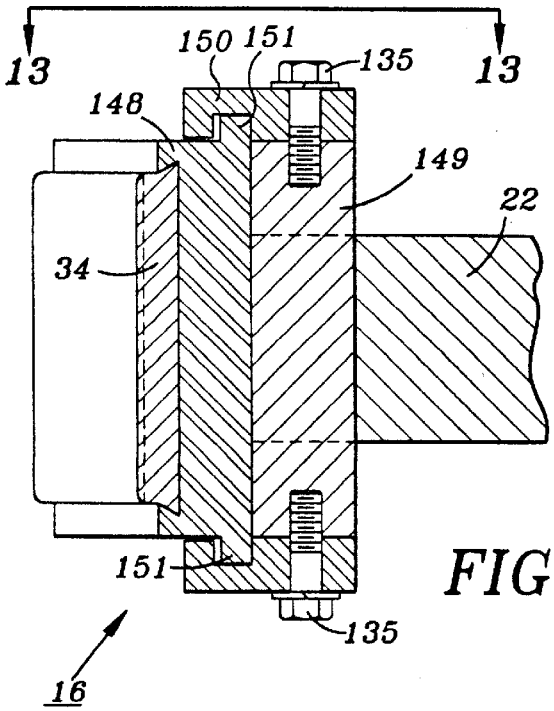
FIG. 12 is a partial sectional view taken along the lines 12—12 of FIG. 13.
Figure 13:
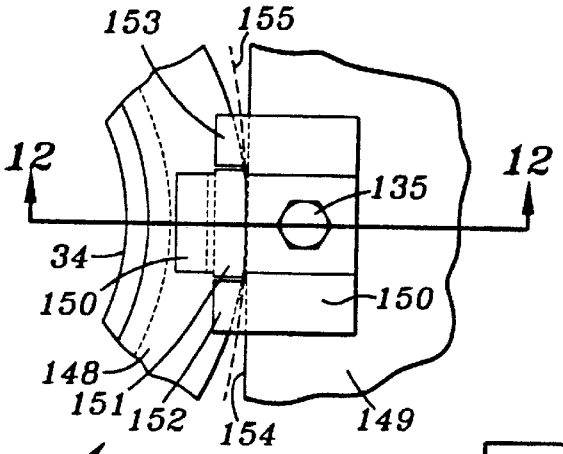
FIG. 13 is a partial top view taken of FIG. 12.

FIGS. 12 and 13 show jaw assembly 16. Assembly 16 provides radial alignment with irregular pipe shapes by virtue of jaw segment 148 rocking on flat surface 154 or concave surface 155 which is slightly larger than outside radius of jaw segment 148. The jaw segment 148 is loosely retained radially by clip 150 which overlaps the lug 151 on jaw segment 148. Torque loads are retained in one direction by projection 152 on jaw base 149 and in the opposite direction by projection 153 in jaw base 149. These engage lug 151 which is attached to jaw segment 148. Jaw base 149 is connected to pivot arm 22 in the same manner as shown in FIGS. 10 and 11. The retaining means would be on the top and bottom of jaw segment 148.

Figure 14:
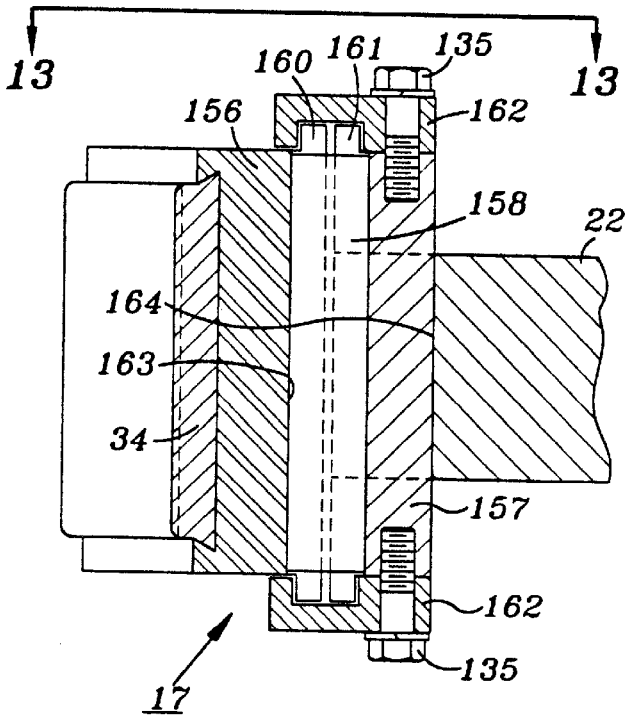
FIG. 14 is a partial sectional view taken along line 14—14 of FIG. 15.
Figure 15:
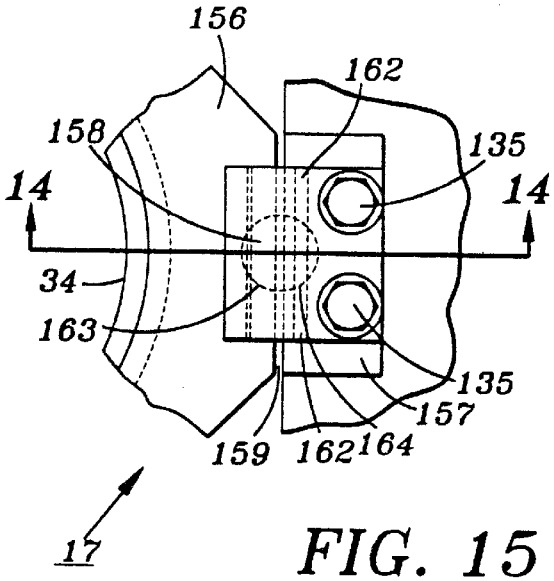
FIG. 15 is a partial top view of FIG. 14.

FIGS. 14 and 15 show a jaw assembly 17. Jaw segment 156 is rotatably mounted to jaw base 157 by a cylindrical dowel 158 which fits into semi-cylindrical groove 163 in the jaw segment 156 and semi-cylindrical groove 164 in jaw base 157. This allows radial movement to align with pipe 33 during the gripping process. Jaw segment 156 is loosely retained by clips 162 which fit over projection 160 from jaw segment 156 and projection 161 from jaw base 157. Clips 162 are held in place by bolts 135. The dowel pin 158 absorbs both compressive loads and torque sheer loads developed by the gripping system. Lubrication means (not shown) is provided to dowel pin 158.

FIG. 16 illustrates a jaw assembly 500 which will work for both open and closed throat power tong gripping systems. This assembly includes a drive gear 527 driven by roller chain or gear teeth with bearings 770 between drive gear 527 and a suitable conventional housing 771 driven by one or two fluid motors (not shown) as described in U.S. Pat. No. 5,172,613.

Drag ring 528 rotates concentric with drive gear 527. Drag ring 528 provides resistance in both rotary directions.

Cam roller 531 rolls along cam surface 535 when drive gear 527 is rotated clockwise to bring jaw 533 to pipe 536. Replaceable friction inserts 534 lie between pipe 536 and jaw 533 to handle different pipe sizes. Likewise, cam roller 531 rolls along cam surface 543 when driven in the opposite direction.

The jaw 533 and insert 534 are the same arrangement as jaw assembly 18 in FIGS. 2 and 4 and pivot about pin 532. Jaw link 530 and 530A (on far side of drag ring 528) and cam roller 531 also pivot on jaw pin 532. The opposite ends of jaw links 530 and 530A pivot on pin 529 near side and 529A far side of drag ring 528. Leg 544 on either or both jaw links 530 and 530A operate with spring 545 to urge jaw assembly 500 to a retracted position where cam roller 531 is urged into recess 546. Recess 546 may be of irregular shape to accommodate cam roller 531 in the retracted position.

In designing the cam geometry shown in FIG. 16 for proper grip on pipe 536 the following steps are followed:

First: As shown in FIG. 16B the total gripping force FRT is determined by taking the smallest pipe diameter 536 to be torqued. Pipe tangential force FTP is calculated as the maximum torque selected divided by the radius 542 of pipe 536.

Second: A gripping factor between 1.2 and 15 is selected which will not allow the jaw assemblies to slip on the pipe under torque loads. For example, a grip factor of four works well on 2⅜ inch O.D. pipe for a selected torque 5,000 foot pounds with proper tooth pattern (explained later). This means that FTP times 4 equals FRT the total radial force required in this case to grip the pipe. (Grip factor is FRT÷FTP).

Third: A torque force factor FT is calculated as the selected torque in inch pounds divided by the distance from the point cam roller 531 touches cam surface 535 to center point 540.

Fourth: To find force angle C, the tangent of FT divided by FRT gives the force angle C. in degrees. This angle will be between 1 degree and 15 degrees. Usually a force angle C. of 4 to 6 degrees works well depending on pipe size, selected torque and tooth pattern.

Fifth: To design a cam surface L1 with a selected force angle C., construct a right triangle where the hypotenuse equals L1 and the side opposite angle C. is designated H2. Solving this triangle, force angle C=sine (H2/L1).

Sixth: Divide FRT by the number of cam surfaces to determine the radial force FR for each jaw assembly. These are called "active jaws".

The optimum number of cam surfaces and jaw assemblies is three, although this quantity may vary.

Jaws which do not apply gripping force from cam surfaces are called "reactive jaws." Any combination of active jaws and reactive jaws may be utilized.

In FIG. 16 a rigid jaw where the jaw links are integral with the jaw (not shown) may be used where a pivoted jaw is not wanted. This rigid jaw would have replaceable inserts 534 also.

FIG. 16A shows a drive gear 527 with three cam surfaces 551, 552 and 553 as described in FIG. 16. This drive gear allows three active jaw assemblies 500 and an open face tong where pipe is inserted from the side through opening 548. This opening 548 does not exist in a closed face tong where pipe is inserted axially through the cam ring. (Drag ring 528 not shown).

When drive gear 527 is rotated in either direction all jaw assemblies 500 are brought to the pipe simultaneously and the drive gear 527 applies radial force to the pipe. Spring 545 returns jaws assemblies 500 to the retracted position when opening 548 and drag ring 527 are aligned to receive the pipe 536 through opening 548.

Angles 549 and 550 to center line of each cam surface each maybe from zero degrees to 55 degrees depending on clearance within the tong to receive pipe 536. 15 degrees to 35 degrees works best in most cases.

Jaw assemblies 500 and cam surfaces 551 and 552 may be active jaws and the throat jaw in cam position 553 may be a reactive jaw. Drag ring 528 may be restrained by conventional brake bands or hydraulic drag means as described in U.S. Pat. No. 5,172,613.

FIGS. 17, 17A, 17B and 18 illustrate a backup tool 22A which is capable of gripping many sizes of pipe between tubular 166 and tubular 165 (illustrated in broken lines). Backup tool 22A has a unique gripping system comprising jaw assembly 20A which provides a gripping force in proportion to the applied torque to tubular 166 and intermediate diameters up to tubular 165. Backup tool 22A has a frame or body 171 with a projection arm 174 which is supported from the tong bracket or support 175 and arm 174 has a shaft 177 on which roller 176 rotates. The shaft 177 has a flange 178 which retains roller 176 on shaft 177.

Once installed, the backup tool 22A grips in one direction. Accordingly, to permit backup tool to grip in the opposite direction, the backup tool 22A is pulled away from support 175 so that roller 176 on shaft 177 seats in support 175. Backup tool 22A is then rotated 180° and pushed back into the support 175 for gripping in the opposite direction. Flange 178 keeps the tool from being pulled completely through support 175. It will be appreciated by those skilled in the art that any type of support from the power tong can be utilized so long as arm 174 may be held in one position and move 180° to the opposite direction.

Jaw assembly 20A has jaw member 167 attached by pivot pin 168 to pivot cranks or arms 169 and 169*a*. Jaw assembly 20A is actuated by pivot arms 169 and 169*a* between pivot pin 168 in the jaw member 167 and pivot 170 in the frame or body 171. Pivot arms extend out to pin 210 and 210*c* which are, respectively, at one end of fluid cylinder 173 on top and fluid cylinder 173A on bottom. The opposite ends of cylinders 173 and 173A are attached to body 171 to pins 210*a* and 210*b*. Sometimes only one fluid cylinder may be sufficient. In FIG. 17B, jaw assembly 20A is shown in the retracted position 180 and the retracted position of pin 210 is shown as 179. When jaw assembly 20A is retracted as shown by position 180 and pin 179, fluid cylinders 173 and 173A are pulled to position illustrated in FIG. 17B. This allows one of the pipe sizes from tubular 166 to tubular 165 access to the throat 23A of the backup tool 22A.

Figure 17:
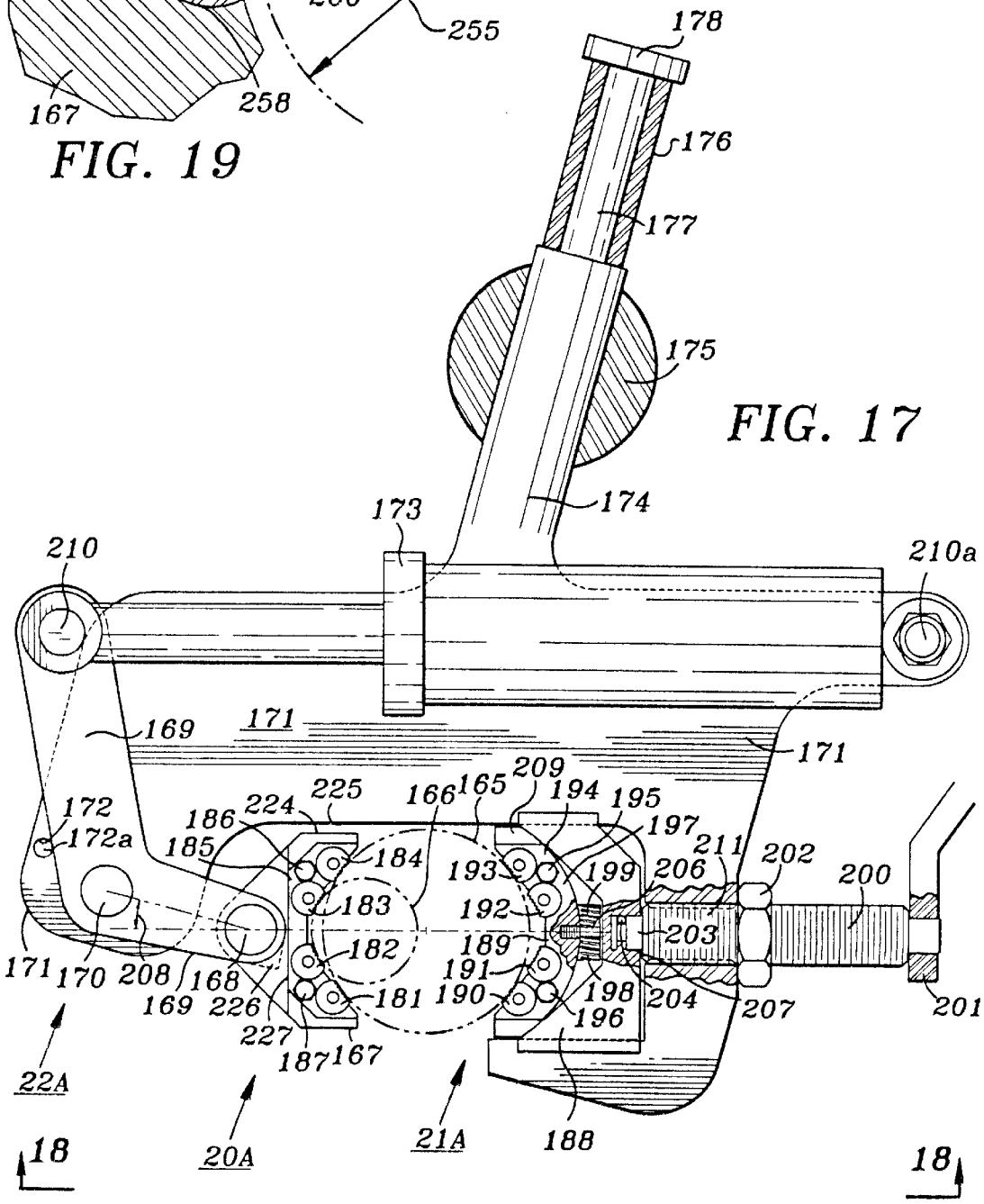
FIG. 17 is a plan view of alternate embodiment of unidirectional backup tool gripping a large diameter pipe.
Figure 17A:
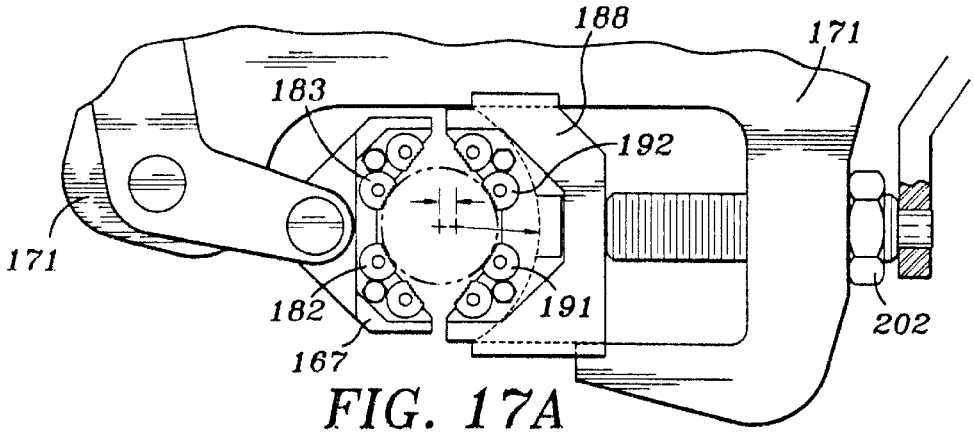
FIG. 17A is a broken-out view of FIG. 17 clamping a small diameter pipe.
Figure 17B:
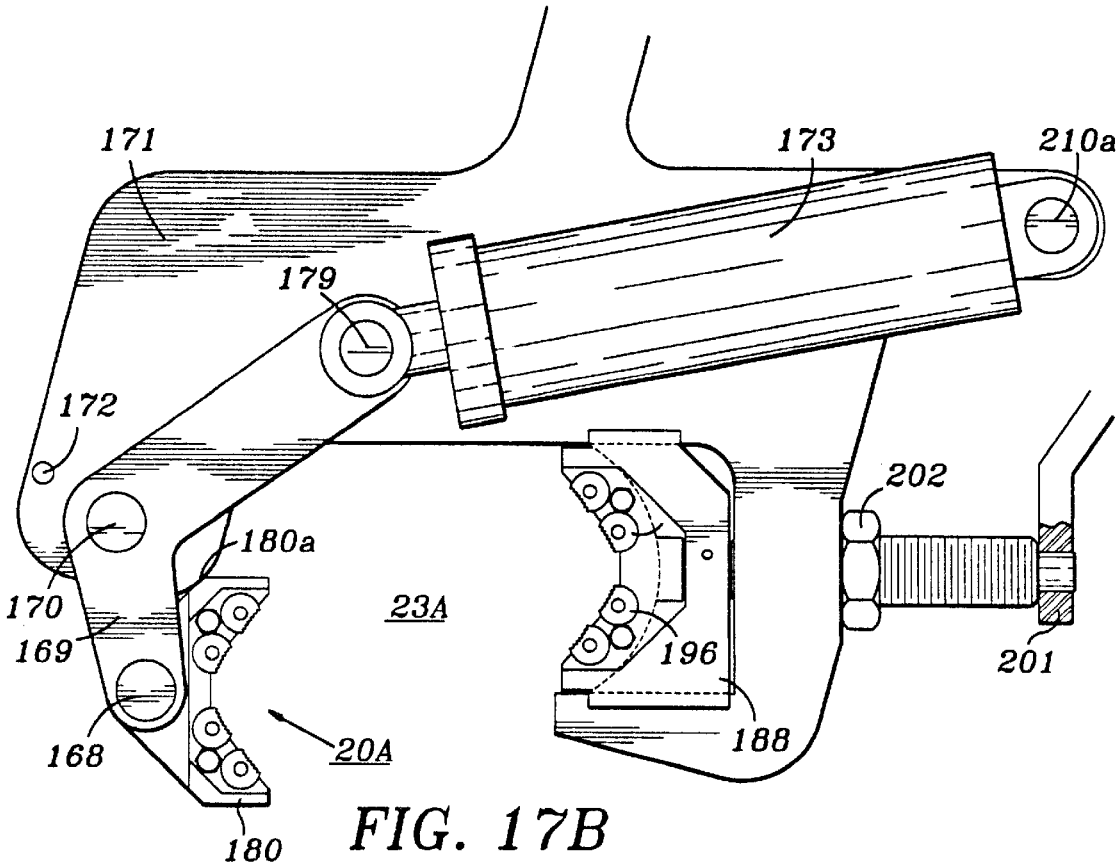
FIG. 17B is a broken-out view of the jaw assemblies of FIG. 17 in the open position.

In operation, tubular 166 or tubular 165, or any size in between, is placed in throat 23A as shown in FIGS. 17 and 17A. The jaw segment 209 is rotatably mounted in the jaw support 188. The radius of jaw segment 209 to jaw support 188 is equal to or less than the radius of the smallest diameter pipe to be used as with a larger radius it would tend to slip with the smaller size of pipe. To set the backup tool 22A for operation, the jaw support or pivot arms or cranks 169 and 169*a* are positioned approximately as shown in FIG. 17 and a dowel pin 172*a* is dropped into hole 172 at the point where the cylinders 173 and 174A push pivot arms 169 and 169*a* into engagement with dowel pin 172*a*. Angle 208 is predetermined such that when the preload of cylinders 173 and 173*a* are placed on pivot arms 169 and 169*a*, respectively, and it has been found that angle 208 may be between 2 and 25 degrees and preferably between 10 and 15 degrees and pivot arms 169 and 169*a* are forced to rotate around pin 170 counterclockwise and restrained by pin 172*a*.

Acme or buttress threaded shaft 200 is turned by crank 201 in the threaded portion 211 of body 171 which rotates shaft extension 203 retained by pin 204 in the groove shown with the jaw base 188. The load between the threaded shaft 200 and the jaw base 188 bears on surface 207. Crank 201 is turned, translating jaw base 188 towards jaw member 167 until the proper size pipe is snug between large inserts 190 and 193 or small inserts 191 and 192 in jaw segment 209 and large inserts 181 or 184 or small inserts 182 and 183 in jaw member 167, respectively.

When either the large or small inserts are firmly compressed against the pipe 166, 165 or the size in between, the lock nut 202 is secured on shaft 200 abutting body 171 so that the position is maintained. At this point, fluid cylinders 173 and 173*a* are retracted, releasing pin 172*a* so that the pivot arms 169 and 169*a* and jaw assembly 20A are fully operational. Angle 208 on pivot arm 169 is determined to provide the proper preload since the cylinders 173 and 173*a* do not provide the fill gripping force but only preload. As the pipe tends to rotate clockwise with the applied torque from the power tong near and above the backup tool 22A, pivot arm 169 tends to rotate counterclockwise reducing angle 208 which increases the force of jaw member 167 on the pipe begin gripped. To eliminate over-travel, surface 224 of jaw member 167 is designed to stop against surface 225 on the body 171 where angle 208 approaches zero degrees.

Jaw assembly 20A as shown has four inserts 181, 182, 183 and 184 for gripping the pipe and jaw assembly 21A as shown has four inserts 190, 191, 192 and 193 for gripping the pipe. Each of these inserts is cylindrical on the portion away from the pipe and has teeth on the portion engaging the pipe. For gripping several small sizes of pipe, inserts 182, 183, 191 and 192 are engaged (see FIG. 17A). For gripping larger sizes of pipe inserts 181 and 184 are utilized as well as inserts 190 and 193. The radii to the tips of the teeth of inserts 182, 183, 191 and 192 are approximately the same as the outside radius of the smallest tubing to be gripped within the small size range. The radii to the tips of the teeth of inserts 181, 184 and 190 and 193 conform to the smallest pipe to be gripped within the large size range.

Cylindrical gripping inserts 181, 182, 183 and 184 are retained by a plate 185 secured by bolts 186 and 187 to jaw member 167. Likewise, cylindrical gripping inserts 190, 191, 192 and 193 are retained by plate 194 secured by bolts 195 and 196 which bear against the jaw base 188 on each side of the two flat sides of threaded screw 206.

Figure 18:
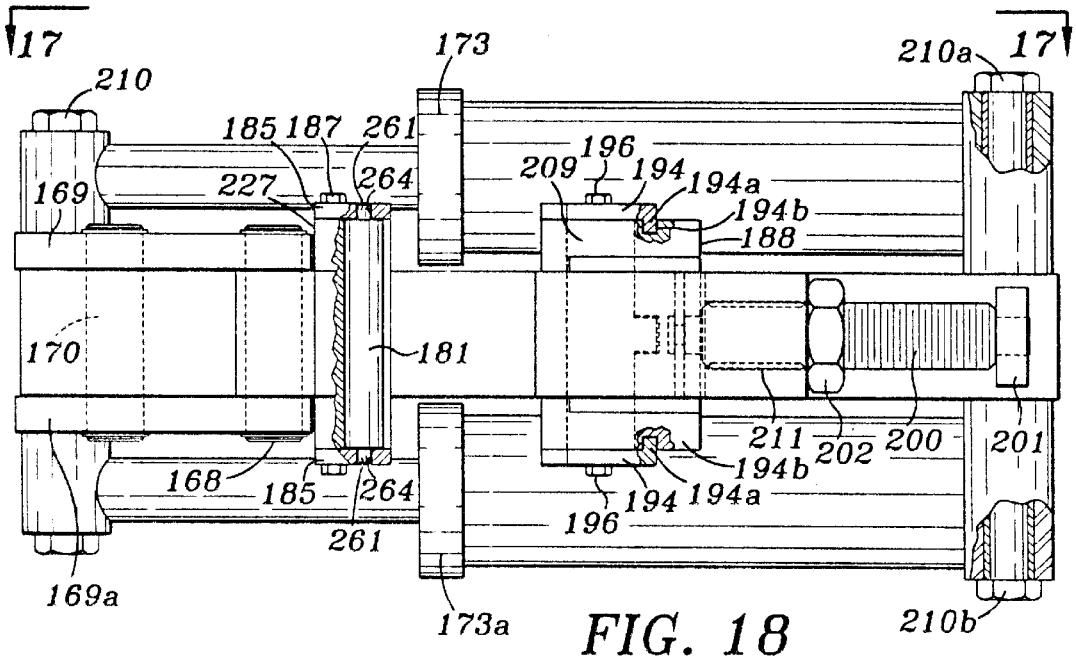
FIG. 18 is a front view of the gripping assembly of FIG. 17 for handling different pipe sizes with the same rotary gripping means.

Referring to FIG. 18, the jaw segment 209 is retained within the jaw base 188 by top and bottom projections 194A from cap 194 which extends into a groove 194B in jaw base 188 loosely fitting to retain jaw segment 209 in operational integrity with the jaw base 188.

Figure 19:
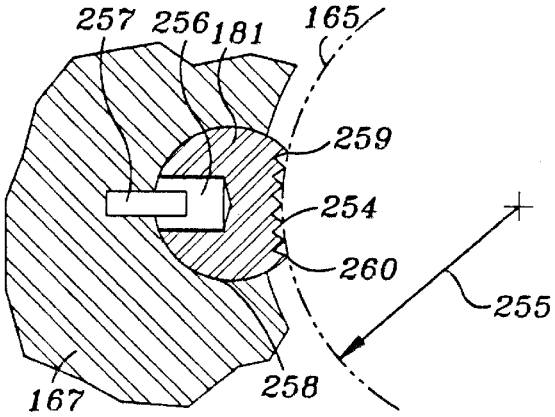
FIG. 19 is a partial cross sectional view of the cylindrical dies in FIG. 17.

FIG. 19 shows generally cylindrical gripping die 181 with teeth 254 and a cylindrical body 181*a* which fits into cylindrical surface 258. This arrangement is illustrative of the dies in jaws 167 and 209. The dies are relatively loose fit because of the corrosion involved in the operation of power tongs and backup tools. Threaded portion 256 (one or more holes in cylindrical die 181) is placed over a roll pin 257 to limit rotation. The teeth 254 are in the shape of an arc 255, equivalent to the smallest diameter pipe O.D. to be gripped by this particular die. The teeth match the smallest diameter so that when larger diameters are used in the same die, the points which touch the pipe outside diameter are shown as teeth 259 and 260. This prevents the tendency for pipe 165 to roll out of the cylindrical die 181. Threaded portion 256 serves as a means of holding the cylindrical die 181 in a fixture of machining the teeth 254. Referring to FIG. 18, cylindrical die 181, as well as the plurality of cylindrical dies, is held in position by cylindrical boss 261 at each end of die 181 concentric with the diameter of die 181 and the other cylindrical dies. These two bosses 261 fit in loosely fitted holds 264 in top and bottom plates 185 if both are used. This is the same to hold all the cylindrical dies in jaw 167 and jaw 209. Roll pins 257 are embedded in jaw 167 to limit movement of the cylindrical dies 181, 182, 183 and 184. Roll pin 257 will hit either side of tapped hole 256 so that the pivoting of the cylindrical dies with the controlled. This is the same arrangement for all dies in jaw 209.

Figure 20:
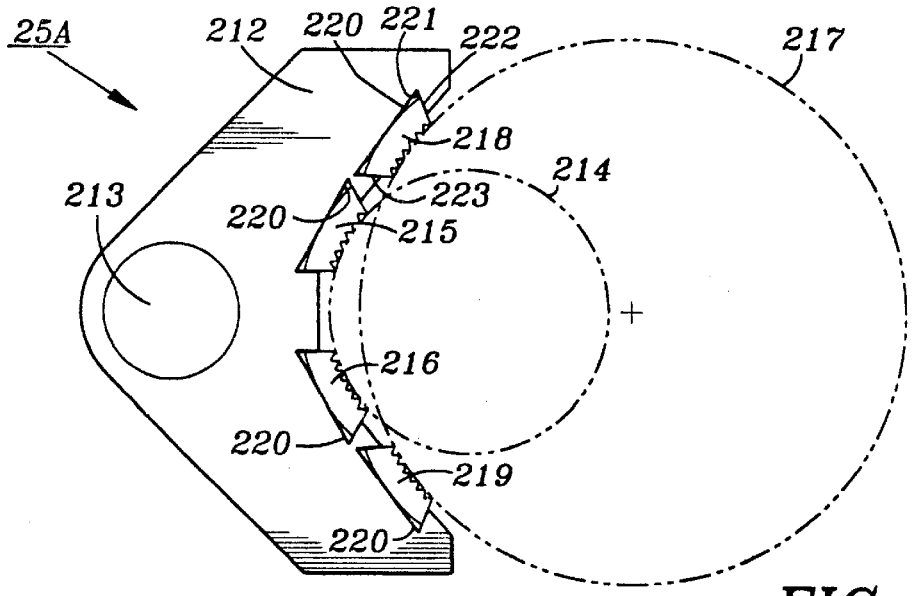
FIG. 20 is an alternate arrangement for rotary gripping dies.

An alternate jaw 25A is shown in FIG. 20. Jaw 212 has four flat surface recesses 220 in which arcuate backs of inserts 218, 215, 216, and 219 rock on the flat surface of recesses 220 to assure alignment with different pipe diameters. The operation of jaw assembly 25A is the same as assembly 20A. Any combination of cylindrical tooth dies and flat tooth dies may be utilized as desired. The pivot arm 169 is shown on the near side of body 171 and the far side at arm 169*a* is connected by pin 170. Likewise, pin 168 through jaw 167 is through both pivot arms 169 and 169*a*.

As best seen in FIG. 20 inserts 215, 216, 218 and 219 are loosely retained within recesses 200 by dovetail bevels 222, 223 by plates 185 and 194 as seen in FIG. 17. Pivot arms 169 and 169*a* would attach to pin 213 similar to the arrangement in jaw assembly 20A.

Figure 6:
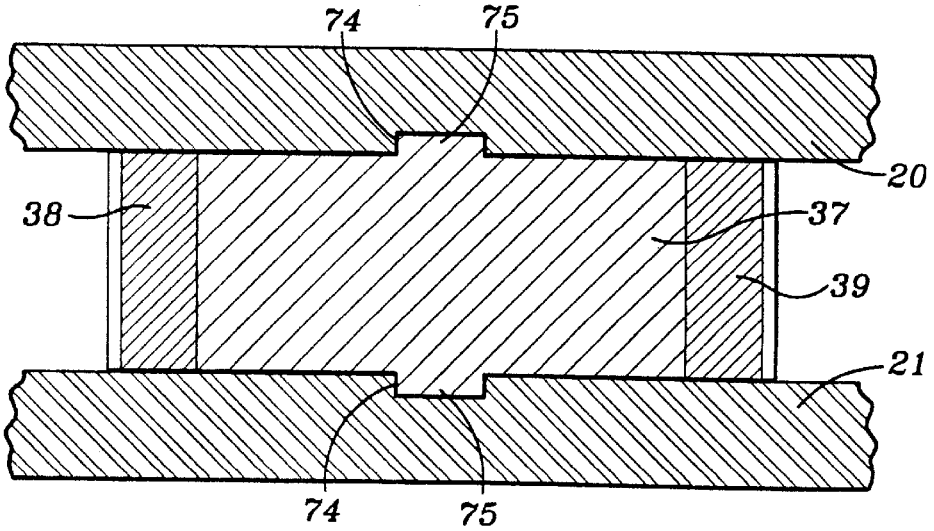
FIG. 6 is a sectional view taken along line 6—6 in FIG. 2.
Figure 21:
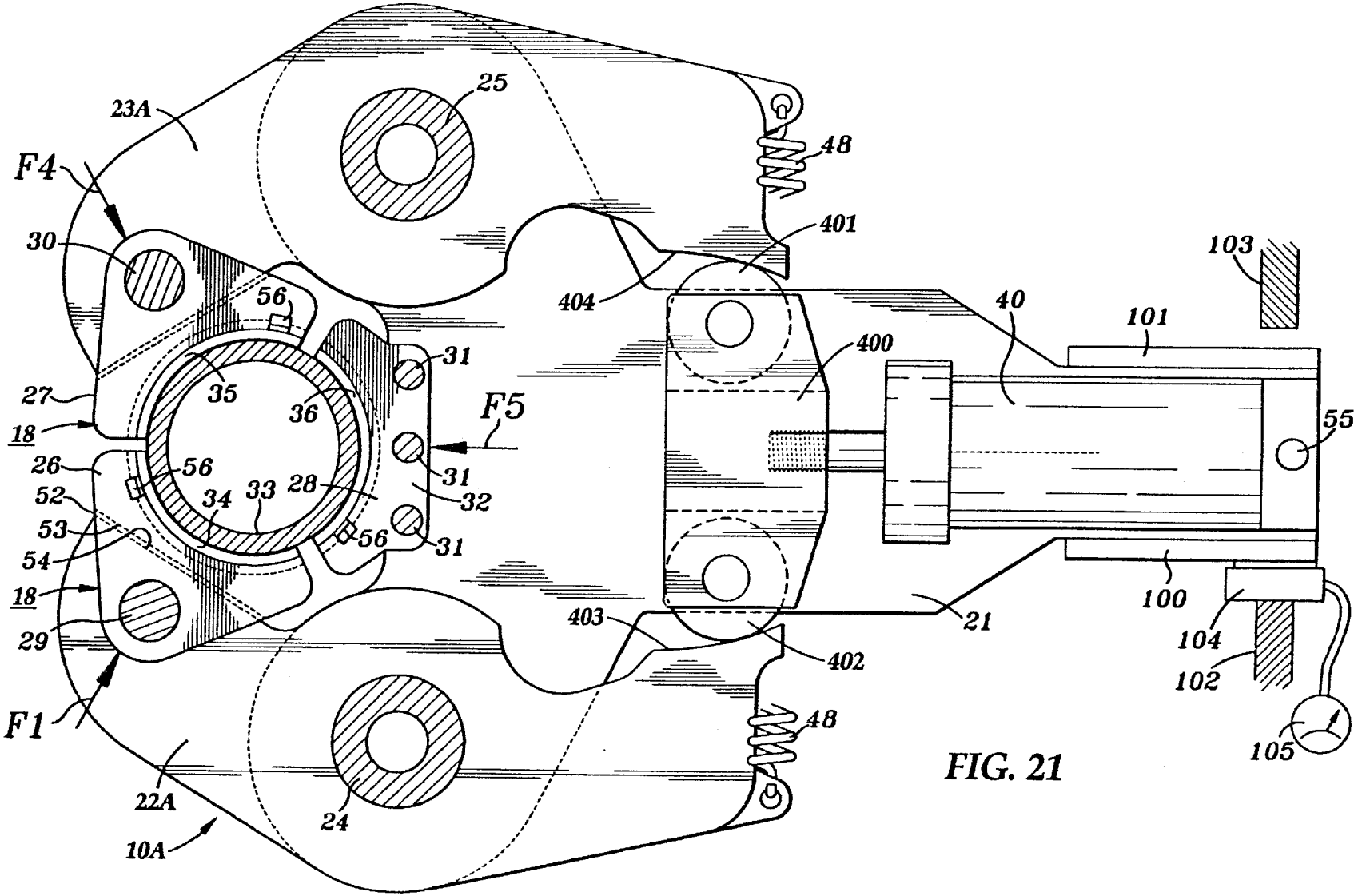
FIG. 21 is a plan view of a bidirectional backup tool in accordance with the present invention which has a pipe clamped in the jaws of the tool.
Figure 22:
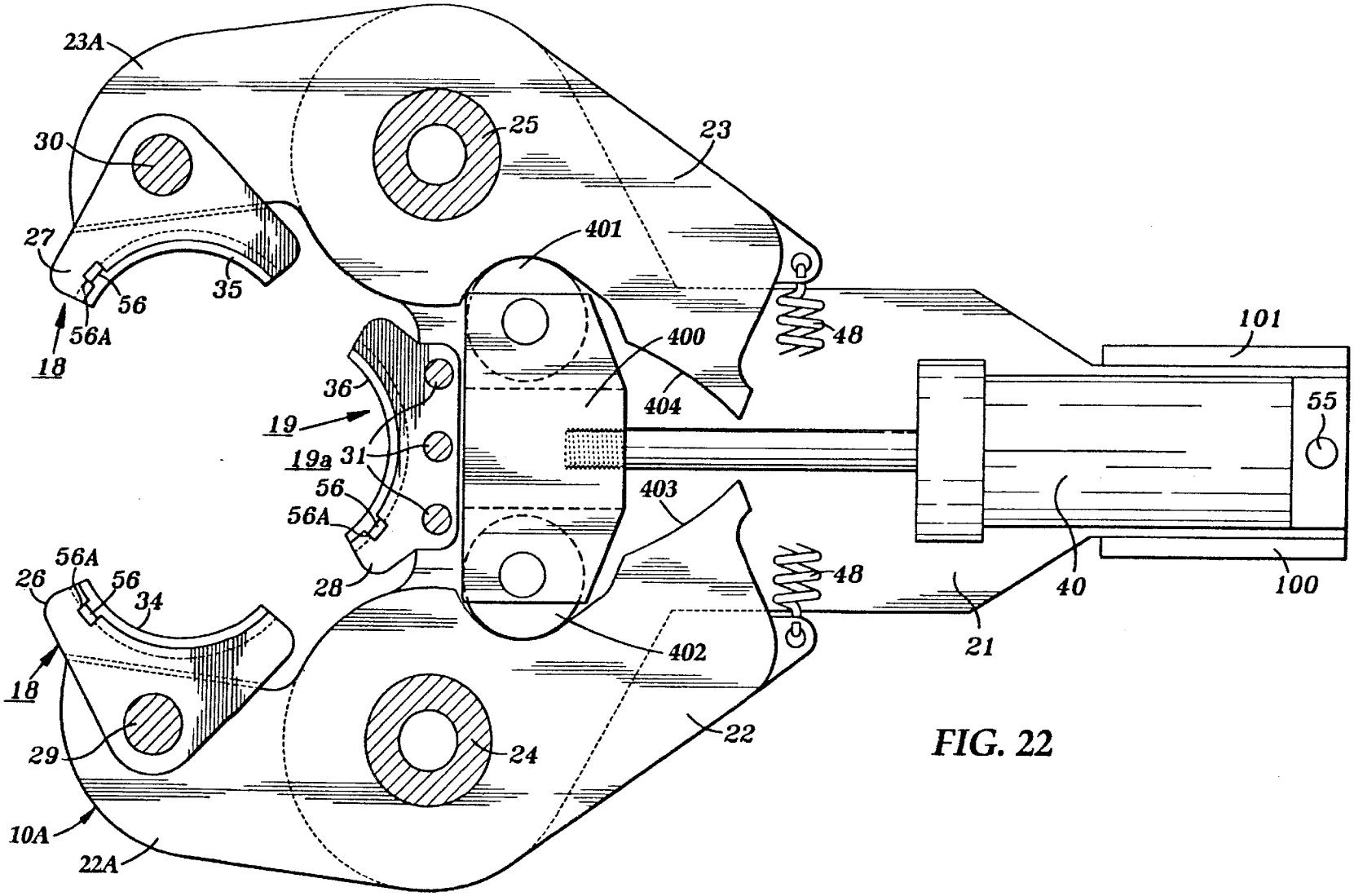
FIG. 22 is a plan view of the tool of FIG. 21 with the jaws open.
Figure 23:
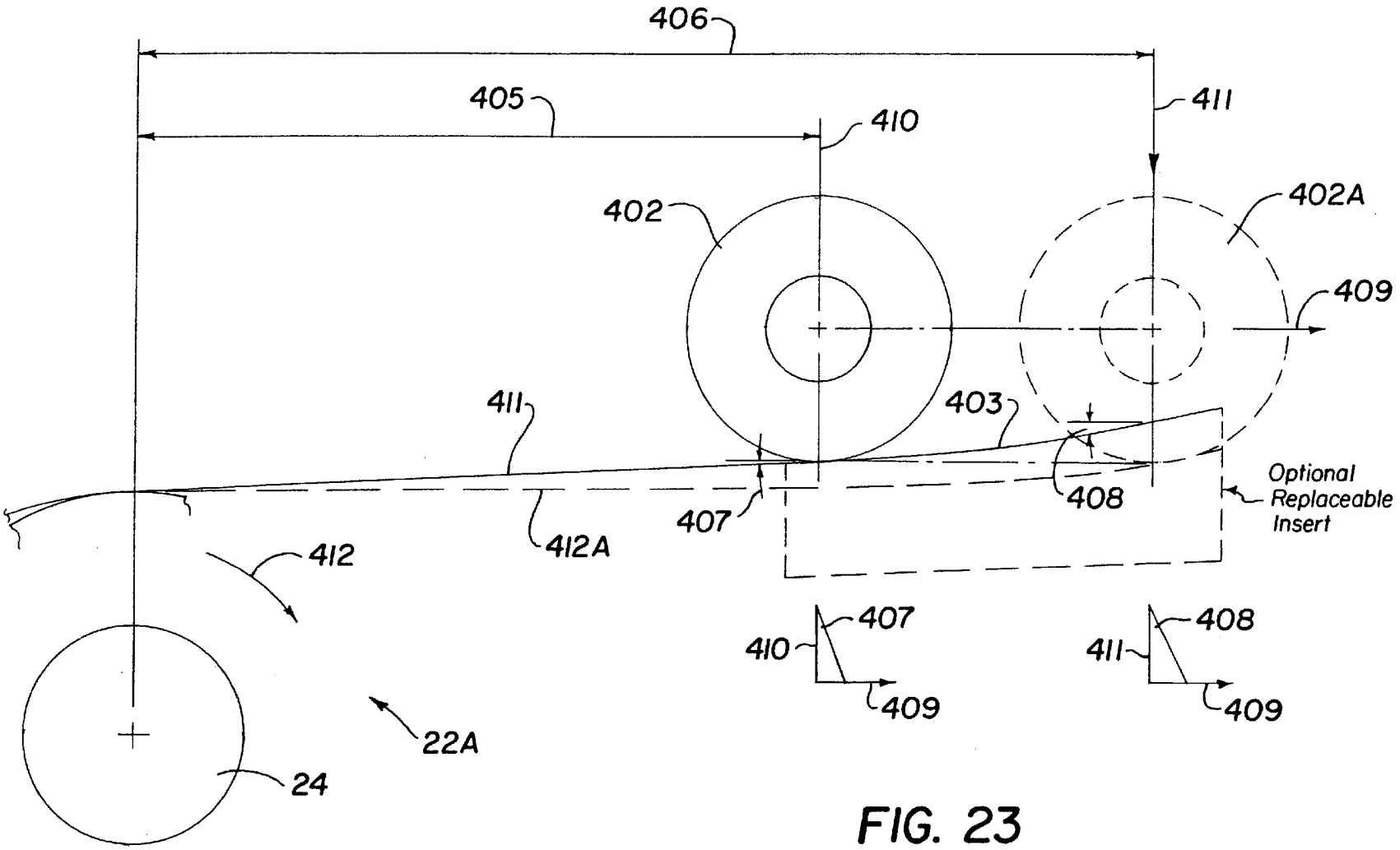
FIG. 23 is a schematic drawing illustrating various force vectors in the tool of FIG. 21.

Another embodiment of backup tool is illustrated in FIGS. 21, 22 and 23. Bidirectional backup tool 10A comprises a frame or body 9 formed by spaced top and bottom plates 20 and 21. Pivot arms 22 and 23 are pivotally secured to the body 9 by pivot pins 24 and 25, respectively. The above description in connection with FIG. 3 applies to the manner in which the pivoting pins are attached to top plate 20 and lower plate 21 and to pivot arms 22 and 23. Active jaws 26, 27 and reactive jaw 28 are positioned within the bidirectional backup tool 10A with active pivoted jaw 26 attached to pivot arm 22A by jaw pin 29. Active pivoted jaw 27 is attached to pivot arm 23A by jaw pin 30. The rest of assembly 10A is the same as assembly 10 except FIGS. 5 and 6 would not apply. Assembly 10A could also be actuated by fluid motor per assembly 11.

The embodiment of FIGS. 21 and 22 comprises a force roller assembly 400 with replaceable rollers 401 and 402 which engage inclined or arcuate cam surfaces 404 and 403 on arms 22A and 23A which establishes a cam-like or ramp face. By actuating fluid cylinder 50 (the rod of which is threaded into roller assembly 400), roller assembly 400 is pulled to the right, causing the pivot arms 22A and 23A to pivot around the pivot pins 24 and 25 so that active pivoted jaws 26 and 27 of pivot arms 22A and 23A are moved into engagement with pipe 33. Initially, hardened rollers 401 and 402 of roller assembly 400 engage hardened cam surfaces 403 and 404 of pivot arms 22A and 23A which moves active jaws 26 and 27, respectively, snugly against pipe 33. Then cam surfaces 403 and 404 engage rollers 402 and 401 and pivot arms 22A and 23A rotate about pivot pins 24 and 25. Cam surfaces 403 and 404 may be replaceable hardened inserts attached to arms 22A and 23A.

The embodiment of FIGS. 21, 22 and 23 may be actuated as described for FIGS. 7 and 9. The pivoting arms 22A and 23A applies force through active jaws 26 and 27 against the pipe 33 abutting reactive jaw 28 in proportion to the amount of force applied by fluid cylinder 40. To release the pipe 33, roller assembly 400 is pushed by fluid cylinder 40 to the left into the retracted position 47. By an extension spring 48 attached to pivot arms 22A and 23A, rollers 401 and 402 are biased to engage surface 404 and 403. This enables the pivot arms 22A and 23A to work active jaws 26 27 in and out of engagement with pipe 33 abutting reactive jaw 28. All other aspects of FIGS. 21 and 22 are same as FIGS. 1, 1A, 1B, and 1C.

The combination of the rollers 401 and 402 and arcuate cam surfaces 403 and 404 also comprise a force multiplying device. Once again, this is because the force applied to pipe 33 is substantially greater than the force required to pull the rollers along the arcuate cam surfaces into a gripping position.

FIG. 23 is a schematic drawing showing the curved cam 403 and arm 22A which pivots about pin 24. The required torque 412 is determined from the predetermined gripping force F1 on jaw 26 multiplied by the distance from jaw pin 29 and arm pivot 24.

Arm 22A position 410 with roller position 402 a distance 405 from pin 24 is the position with pipe 33 at its largest acceptable diameter. Arm 22A position 412 with roller portion 402A a distance 406 from pin 24 is the position with pipe 33 at its smallest acceptable diameter.

To convert actuator 40 or 76 pull force 409 to torque 412, force 410 in roller position 402 is determined by dividing torque (in lbs) by distance 405. Since we now know force 409 and force 410 we can determine angle 407, the tangent of which equals force 409 divided by force 410.

This procedure is done for several increments of distance between distance 405 and 406. The served calculated angels between angle 407 and 408 can be plotted to determine the curved cam surface 403 which will provide the same force F1 on jaw 26 regardless of position of roller 402 between distance 405 and 406. This is true of the cam surface 404 on arm 23A and cam roller 401.

It is important that due to large stresses created between rollers 401 and 402 on cam surfaces 403 and 404 these components should be a steel heat treated to Rockwell 15 to 76 on the "C." scale. Rockwell C-37 to C64 is an acceptable hardness range.

Although the invention has been described in conjunction with specific forms thereof, many alternatives, modifications and variations will be apparent to those skilled in the art in light of the foregoing disclosure. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and describe herein, parts may be reversed, and certain features of the invention may be utilized independently of the use of the other features, all as would be apparent to one skilled in the art after having the benefit of this description of the invention.

What is claimed:

1. Apparatus for gripping the surface of and simultaneously applying rotational torque about a longitudinal axis of a tubular element comprising:

(a) a drive gear rotatably mounted to a housing and having an inner surface which defines a plurality of camming surfaces;

(b) a drag ring supported by said housing adjacent said camming surfaces and rotatable with respect to said housing and said camming surfaces;

(c) a gripping assembly supported by said drag ring and adapted for movement between a retracted position and an extended position in contact with the surface of a tubular element, said gripping assembly including (i) at least one jaw link defining a first end and a second end with the first end pivotably mounted to said drag ring and the second end pivotable about a pin;

(ii) a jaw; and (iii) a cam roller wherein said jaw and said cam roller are mounted to pivot about said pin independently of each other and said cam roller is adapted to ride on said camming surface when said drag ring and said drive gear rotate with respect to each other and force said jaw into engagement with the surface of the tubular element extending axially through said housing and apply torque thereto when rotated in a first direction and to disengage the jaw from the tubular element when rotated in the opposite direction;

(d) a gripping surface on the face of said jaw opposite said pin; and (e) a brake mechanism which, when activated, substantially prevents rotation of said drag ring until a predetermined gripping force is applied to the surface of the tubular element by the gripping assemblies.

2. Apparatus as defined in claim 1 including at least three cam surfaces and three gripping assemblies.

3. Apparatus as defined in claim 1 including at least two cam surfaces, at least two gripping assemblies and at least one reactive jaw.

4. Apparatus as defined in claim 1 wherein a camming surface force angle from about one to about fifteen degrees is employed.

5. Apparatus as defined in claim 4 wherein said force angle is greater than two and less than eleven degrees.

6. The combination comprising:

(i) apparatus for gripping the surface of and simultaneously applying rotational torque about a longitudinal axis of a tubular element comprising:

(a) a drive gear rotatably mounted to a housing and having an inner surface which defines a plurality of camming surfaces;

(b) a drag ring supported by said housing adjacent said camming surfaces and rotatable with respect to said housing and said camming surfaces;

(c) a gripping assembly supported by said drag ring and adapted for movement between a retracted position and an extended position in contact with the surface of a tubular element, said gripping assembly including (i) at least one jaw link defining a first end and a second end with the first end pivotably mounted to said drag ring and the second end pivotable about a pin;

(ii) a jaw; and (iii) a cam roller wherein said jaw and said cam roller are mounted to pivot about said pin independently of each other and said cam roller is adapted to ride on said camming surface when said drag ring and said drive gear rotate with respect to each other and force said jaw into engagement with the surface of the tubular element extending axially through said housing and apply torque thereto when rotated in a first direction and to disengage the jaw from the tubular element when rotated in the opposite direction;

(d) a gripping surface on the face of said jaw opposite said pin; and (e) a brake mechanism which, when activated, substantially prevents rotation of said drag ring until a predetermined gripping force is applied to the surface of the tubular element by the gripping assemblies; and (ii) a jaw insert comprising:

(a) a body having a first convex surface and a second concave surface with teeth thereon adapted to grip the external surface of a tubular element extending through said apparatus; and (b) a key extending from said convex surface adapted to mate with a keyway in said jaw and thereby secure said insert to said jaw.

* * * * *